US005135833A

United States Patent [19]

Matsunaga et al.

[11] Patent Number: 5,135,833

[45] Date of Patent: Aug. 4, 1992

[54] ELECTROSTATIC IMAGE DEVELOPING TONER AND FIXING METHOD

[75] Inventors: Satoshi Matsunaga; Takashige Kasuya, both of Tokyo; Hiroaki Kawakami, Kawasaki; Kiyoko Tsuchiya; Yusuke Karami, both of Yokohama; Shinji Doi, Kawasaki, all of Japan

[73] Assignee: Canon Kabushiki Kaisha, Tokyo, Japan

[21] Appl. No.: 642,782

[22] Filed: Jan. 18, 1991

[30] Foreign Application Priority Data

Jan. 19, 1990 [JP] Japan ..... 2-010340
Jan. 23, 1990 [JP] Japan ..... 2-011724

[51] Int. Cl.[5] ..... G03G 11/00
[52] U.S. Cl. ..... 430/110; 430/904
[58] Field of Search ..... 430/110, 904

[56] References Cited

U.S. PATENT DOCUMENTS 2,297,691 10/1942 Carlson ..... 95/5
4,853,311 8/1989 Tavernier et al. ..... 430/109
4,966,829 10/1990 Yasuda et al. ..... 430/109

*Primary Examiner*—Marion E. McCamish
*Assistant Examiner*—S. Rosasco
*Attorney, Agent, or Firm*—Fitzpatrick, Cella, Harper & Scinto

[57] ABSTRACT

A toner for developing an electrostatic image, comprises a binder resin and a colorant. Such binder resin contains a THF-insoluble matter in an amount of less than 10 wt. % based on the binder resin, and, in the molecular weight distribution measured by GPC (gel permeation chromatography) of a THF-soluble matter, has a weight average molecular weight/number average molecular weight ($\overline{M}w/\overline{M}n$) of $\geqq 18$, a molecular weight peak MA in the region of a molecular weight of from 3,000 to 20,000, a molecular weight peak MB in the region of a molecular weight of from 380,000 to 1,000,000, a molecular weight minimum Md in the region of a molecular weight of from 20,000 to 380,000, provided that MB/MA is in the range of from 30 to 150, and a molecular weight distribution curve area ratio SA:SB:Sd of 1:0.3 to 0.8:0.35 to 0.8.

25 Claims, 3 Drawing Sheets

ELECTROSTATIC IMAGE DEVELOPING TONER AND FIXING METHOD

BACKGROUND OF THE INVENTION

1. Field of the Invention

The present invention relates to a toner for developing an electrostatic image, used in an image forming process such as electrophotography, electrostatic recording or magnetic recording, and a method of fixing the toner.

2. Related Background Art

A number of methods as disclosed in U.S. Pat. No. 2,297,691, Japanese Patent Publication Nos. 42-23910 and No. 43-24748 and so forth are conventionally known as electrophotography. In general, copies are obtained by forming an electrostatic latent image on a photosensitive member by utilizing a photoconductive material, subsequently developing the latent image by the use of a toner, and transferring the toner image to a transfer medium such as paper if necessary, followed by fixing by the action of heat, pressure, heat-and-pressure, or solvent vapor. The toner that has not transferred to and has remained on the photosensitive member is cleaned by various means, and then the above process is repeated.

In recent years, such a copying apparatus is not only used as a copying machine for office work to take copies of originals as commonly done, but also has begun to be used in the field of printers serving as outputs of computers and in the field of personal copying for private use.

Under such circumstances, the apparatus are sought to be made small-sized, lightweight and highly reliable. Copying machines have now been formed of more simple components in various respects. As result, a high performance has become required for toners, and copying machines are no longer considered excellent unless an improvement in the performance of toners is achieved.

For example, various methods or devices have been developed in relation to the step of fixing a toner image to a sheet such as paper. A method most commonly available at present is the pressure-heat system using a heat roller.

The pressure-heat system using a heat roller is a method of carrying out fixing by causing a toner image surface of an image-receiving sheet to pass the surface of a heat roller whose surface is formed of a material having releasability to the toner while the former is brought into contact with the latter under application of a pressure. Since in this method the surface of the heat roller comes into contact with the toner image of the image-receiving sheet under application of pressure, a very good thermal efficiency can be achieved when the toner image is melt-adhered onto the image-receiving sheet, so that fixing can be carried out rapidly. Thus, this method is very effective in high-speed electrophotographic copying machines. In this method, however, since the surface of the heat roller comes into contact with the toner image under application a pressure, part of the toner image may sometimes adhere and transfer to the surface of the fixing roller, which is retransferred to the subsequent image-receiving sheet to cause an offset phenomenon, resulting in a contamination of the image-receiving sheet. Thus, it is considered to be one of the essential conditions in the heat roller fixing system that no toner is adhered to the surface of the heat fixing roller.

For the purpose of not causing the toner to adhere to the surface of a fixing roller, a measure has been hitherto taken such that the roller surface is formed of a material such as silicon rubber or a fluorine resin, having an excellent releasability to toner, and, in order to prevent offset and to prevent fatigue of the roller surface, its surface is further covered with a thin film formed using a fluid having a good releasability as exemplified by silicone oil. However, this method, though effective in view of the prevention of the offset of toner, requires a device for feeding an anti-offset fluid, and hence the problem that the fixing device becomes complicated.

Such complication is in the opposite direction to the demand for small size and light weight. In some instances, the silicone oil is evaporated by heat and contaminates the interior of the machine. Now, based on the idea that the fluid for preventing offset should be fed from the inside of a toner without use of any apparatus for feeding silicone oil, a method has been proposed in which a release agent such as a low-molecular polyethylene or a low-molecular polypropylene is added in the toner. Addition of such a release agent in a large quantity in order to attain a sufficient effect may cause filming onto the photosensitive member or result in a contamination of the surface of a toner carrying member such as a carrier or a sleeve, so that toner images may be deteriorated and to bring about a problem in practical use. Thus the release agent is added in the toner in such a small amount that it does not cause the deterioration of toner images. Accordingly, a releasing oil is fed in a small amount and a device by means of which the toner that may cause offset is cleaned using a member such as a web of a wind-up type are used together.

However, taking account of the recent demand for small size, light weight and high reliability, it is necessary and preferred to remove such a supplementary device. Accordingly, no countermeasure can be completely taken unless the fixing performance and anti-offset of the toner are further improved. It is difficult to achieve the improvement unless binder resins for toners are further improved.

As a technique relating to the improvement of binder resins of toners, Japanese Patent Publication No. 51-23354, for example, proposes a toner in which a cross-linked polymer is used as a binder resin. According to the method disclosed therein, the toner is effective for the improvement in anti-offset and wind-around resistance, but on the other hand an increase in the degree of cross-linking results in an increase in the fixing temperature. Hence it is difficult to obtain a toner having a sufficiently low fixing temperature, a superiority in anti-offset and wind-around resistance, and a sufficient fixing performance. In general, in order to improve the fixing performance, the binder resin must be made to have a low molecular weight to lower its softening point. This conflicts with the measure for the improvement of anti-offset. Since the binder resin is made to have a low softening point, the glass transition point of the resin is necessarily lowered with causes an undesirable phenomenon known as blocking of toner which occurs during storage.

To cope with this problem, Japanese Patent Application Laid-open No. 56-158340 proposes a toner containing a binder resin comprised of a low-molecular weight polymer and a high-molecular weight polymer. This binder resin can achieve an improvement with respect to fixing performance, but is not satisfactory with respect to anti-offset. It is difficult for this toner to completely satisfy the anti-offset and fixing performance.

Japanese Patent Application Laid-open No. 58-203453 proposes a toner containing a binder resin comprised of a low-temperature softening resin and a high-temperature softening resin. This binder resin can achieve an improvement in respect of fixing performance, but is not be satisfactory with respect to anti-offset. It is difficult for this toner to completely satisfy the anti-offset and fixing performance.

Japanese Patent Publication No. 60-20411 proposes a process for producing a resin composition comprising a polymer with a low degree of polymerization and a polymer with a high degree of polymerization. When this resin is used as a binder resin for a toner, the resin tends to achieve an improvement with respect to fixing performance, but is not satisfactory with respect to anti-offset. Thus there is much room for improvement.

In relation to a toner containing a binder resin comprised of a blend of a low-molecular weight polymer and a cross-linked polymer, Japanese Patent Application Laid-open No. 58-86558, for example, proposes a toner comprising a low-molecular weight polymer and an insoluble infusible high-molecular weight polymer as main resin components. According to the method disclosed therein, the fixing performance and grindability tend to be improved. However, it is difficult to satisfy a high performance both of anti-offset and grindability, because the weight average molecular weight/number average molecular weight (Mw/Mn) of the low-molecular weight polymer is not more than 3.5 and the content of the insoluble infusible high-molecular weight polymer is as large as from 40 to 90 wt. %. Thus, it is very difficult from a practical viewpoint to provide a toner satisfying properly fixing performance (in particular, in high-speed fixing), offset resistance and grindability unless a fixing assembly is provided with a device for feeding an anti-offset fluid. Moreover, the toner must be heat-kneaded at a temperature far higher than that in usual instances or heat-kneaded at a high shear, because the insoluble infusible high-molecular weight polymer used in a larger amount turns out to have a very high melt viscosity as a result of the heat-kneading carried out when the toner is prepared. As a result, in the instance where it is kneaded at a high temperature, the toner characteristics may be lowered because of thermal decomposition of other additives. In the instance where it is kneaded at a high shear, the molecules of the binder resin may be excessively sheared. Thus, there is the problem that the desired anti-offset can be achieved only with difficulty.

Japanese Patent Application Laid-open No. 60-166958 proposes a toner comprising a resin composition obtained by polymerizing monomers in the presence of a low-molecular poly($\alpha$-methylstyrene) having a number average molecular weight (Mn) of from 500 to 1,500.

In particular, this publication discloses that the number average molecular weight (Mn) may preferably be in the range of from 9,000 to 30,000. With an increase in Mn for the purpose of improving anti-offset, the fixing performance of the toner and the grindability at the time the toner is prepared may become more questionable from a practical viewpoint. Hence it is difficult to satisfy in a high performance both the anti-offset and the grindability properties. Thus, the toner having a poor grindability at the time the toner is prepared causes a lowering of production efficiency, and also coarse toner particles tend to be included into the toner, undesirably resulting in black spots around a toner image.

Japanese Patent Application Laid-open No. 56-16144 proposes a toner containing a binder resin component having at least one maximum value in each region of a molecular weight of from $10^3$ to $8\times10^4$ and a molecular weight of from $10^5$ to $2\times10^6$, in the molecular weight distribution measured by gel permeation chromatography (GPC). The toner, however, is sought to be further improved in fixing performance and anti-offset.

Japanese Patent Application Laid-open No. 63-223662 proposes a toner comprising a binder resin i) containing 10 to 60 wt. % of a THF(tetrahydrofuran)-insoluble matter, based on the binder resin, ii) having a weight average molecular weight/number average molecular weight (Mw/Mn) of $\geqq 5$, a peak in the region of a molecular weight of from 2,000 to 10,000 and a peak or shoulder in the region of a molecular weight of from 15,000 to 100,000, in the molecular weight distribution measured by GPC of a THF-soluble matter, and iii) containing a component with a molecular weight of not more than 10,000 in an amount of from 10 to 50% by weight in the binder resin. In this instance, the resin can bring about a superiority in the grindability, fixing performance, filming or melt-adhesion resistance to a photosensitive member, image forming performance, and anti-offset (in particular, anti-offset at the high-temperature side), but is desired to achieve a further improvement in its anti-offset and fixing performance for the toner. In particular, it is difficult for this resin to cope with the severe condition when both the fixing performance at low temperature and the anti-offset at a high temperature are required to be simultaneously satisfied.

In addition, it is very difficult to achieve both properties related to properties concerned with fixing and the grindability at a high level of performance. In particular, the grindability required when toners are prepared is an important factor for the recent trend in which toners are made to have a smaller particle diameter because of the demand for a higher quality level, higher resolution and higher fine-line reproduction of copied images. The improvement in grindability is also very important from the viewpoint of energy since a very large energy is required in the step of grinding.

The phenomenon that toner is melt-adhered to the inner wall of a grinding apparatus to provide poor grindability tends to occur in a toner having a good fixing performance. In the process of copying, a step of cleaning the toner remaining on a photosensitive member after transfer is required. Nowadays, from the viewpoint of making apparatus small-sized, light weight and highly reliable, it has become common to carry out cleaning by the use of a blade (i.e., blade cleaning). As photosensitive members are made to have a longer lifetime, as photosensitive member drums are made small-sized and as systems are made high-speed, melt-adhesion resistance and filming resistance to photosensitive members have been more strictly required in toners. In particular, amorphous silicon photosensitive members having been recently put into practical use are highly durable, and also organic photoconductive photosensitive members (OPCs) have longer lifetimes. Hence, the performances required in toners have become higher.

In order to make apparatus small-sized, components must be so designed as to be readily assembled. This requires that the space through which the air flows be small. In addition, heat sources for a fixing assembly and an exposure system are very close to a toner hopper or a cleaner. As a result, toner is exposed to a high-temperature atmosphere. Hence, no toner can any longer be put into practical use unless it has a better blocking resistance.

For example, the performances required in toner conflict with each other in almost all properties, as in fixing performance and blocking resistance. Yet it is increasingly sought and studied to satisfy all such properties and maintain a high performance. No satisfactory results, however, have been obtained.

As previously stated, as a method of fixing a visible image of toner to a recording medium, the heat-roll fixing system is widely used. A recording medium retaining thereon a toner visible image which has not been fixed is heated while it is held and carried between a heat roller maintained at a given temperature. A pressure roller having an elastic layer is moved into pressure contact with the heat roller.

The heat-roll fixing, however, has the following problems that should be resolved.

(1) A waiting time (a time during which an image-forming operation is prohibited) is required until the heating roller reaches the given temperature.

(2) The heating roller must be maintained at a proper temperature in order to prevent poor fixing caused by the variations of heat-roller temperatures that may occur when the recording medium is passed or because of other external factors, and also to prevent the phenomenon of offset of toner on the heating roller. This makes it necessary to make the heat capacity of the heating roller or a heater element large, which requires a large electric power.

(3) After the recording medium has been passed over the heating roller and discharged, the recording medium and the toner on the recording medium are slowly cooled because of the high temperature of the heating roller and also because the atmospheric temperature has become higher. That results in a state in which a high adhesion of the toner is maintained. Thus, there may often occur offset, or paper jam caused by the winding of the recording medium around the roller.

It is earnestly sought to develop a fixing method that has solved such problems, which requires only a short waiting time and which requires a low consumption of electric power while achieving excellent fixing of a toner latent image to a recording medium and excellent anti-offset. Such a fixing method greatly depends on toner properties, and one of the important properties is the low-temperature fixing performance of the toner.

As means for preventing occurrence of the offset phenomenon, the following methods are known as previously stated: (i) The method in which the fixing is carried out while applying a release agent such as silicone oil to the surface of a heating roller, (ii) the method in which a high-molecular weight polymer is used as a binder resin for toner, and (iii) the method in which a wax having release properties is incorporated in a toner.

In the method (i), however, when the oil is heated it generates a smell, and also a device for feeding the oil is necessary which complicates the structure.

In the method (ii), although the anti-offset of the toner can be improved, it is difficult to achieve the low-temperature fixing because of a concurrent rise of the melting temperature of the toner.

In respect of the method (iii), Japanese Patent Publications No. 52-3304, No. 52-3305, No. 57-52574, No. 53-155655 and No. 58-12580, for example, disclose toners comprising a styrene resin and a specific release agent.

Under existing circumstances, however, these toners can achieve an improvement particularly in regard to the high-temperature side offset phenomenon, but little improvement in respect of the low-temperature fixing performance. When such a release agent is used in a binder having low-temperature melting properties, it is difficult for the release agent to have the releasing effect at such low temperatures, thereby tending to cause a low-temperature offset phenomenon. This causes a reduction of fixing performance, and results in a failure to achieve low-temperature fixing performance.

To prevent the high-temperature side offset phenomenon, methods are known in which a high-molecular weight polymer is incorporated in a binder resin. The methods are disclosed, for example, in Japanese Patent Applications Laid-open No. 50-134652, No. 54-114245, No. 56-16144, No. 56-158340 and No. 58-203453.

Most of the toners used in these methods have achieved an improvement in the high-temperature side offset phenomenon, but are required to be further improved in respect of the low-temperature fixing performance. On the other hand, the low-temperature fixing performance have been achieved to a certain extent in some of these methods. A further improvement, however, is sought in respect of development performance and blocking resistance.

SUMMARY OF THE INVENTION

An object of the present invention is to provide a toner that has solved the above problems.

Another object of the present invention is to provide a toner that can be fixed at a low temperature and also has anti-offset in a broad temperature region from low temperatures to high temperatures.

Still another object of the present invention is to provide a toner that causes no melt-adhesion and filming to a photosensitive member in a high-speed system even after use for a long period of time.

A further object of the present invention is to provide a toner that has a superior blocking resistance and particularly can be used well even in a high-temperature atmosphere in a small-sized machine.

A still further object of the present invention is to provide a toner that can be continuously produced at a good efficiency because of the lack of melt-adhesion of a ground product to the inner wall of an apparatus in the course of grinding.

According to the present invention, there is provided a toner for developing an electrostatic image, comprising a binder resin and a colorant, wherein said binder resin contains a THF-insoluble component in an amount of less than 10 wt. % based on the binder resin, and, in the molecular weight distribution measured by GPC (gel permeation chromatography) of a THF-soluble component, has a weight average molecular weight-/number average molecular weight ($\overline{M}w/\overline{M}n$) of $\geqq 18$, a molecular weight peak MA in the region of a molecular weight of from 3,000 to 20,000, a molecular weight peak MB in the region of a molecular weight of from 380,000 to 1,000,000, a molecular weight minimum Md in the region of a molecular weight of from 20,000 to 380,000, provided that MB/MA is in the range of from 30 to 150, and a molecular weight distribution curve area ratio SA:SB:Sd of 1:0.3 to 0.8:0.35 to 0.8 when the area of a molecular weight distribution curve of a molecular weight of from 400 to the Md is represented by SA, the area of a molecular weight distribution curve of a molecular weight of from the Md to 5,000,000 by SB, and the area of the region defined by a straight line connecting the apex A (apexA) corresponding to the molecular weight peak MA and the apex B (apexB) corresponding to the molecular weight peak MB and a molecular weight distribution curve by Sd.

According to another aspect of the present invention, there is provided a heat fixing method comprising;

Transferring a toner image onto a recording medium, wherein a toner that forms said toner image comprises a binder resin and a colorant, wherein said binder resin contains a THF-insoluble component in an amount of less than 10 wt. % based on the binder resin, and, in the molecular weight distribution measured by GPC (gel permeation chromatography) of a THF-soluble component, has a weight average molecular weight/number average molecular weight ($\overline{M}w/\overline{M}n$) of $\geqq 18$, a molecular weight peak MA in the region of a molecular weight of from 3,000 to 20,000, a molecular weight peak MB in the region of a molecular weight of from 380,000 to 1,000,000, a molecular weight minimum Md in the region of a molecular weight of from 20,000 to 380,000, provided that MB/MA is in the range of from 30 to 150, and a molecular weight distribution curve area ratio SA:SB:Sd of 1:0.3 to 0.8:0.35 to 0.8 when the area of a molecular weight distribution curve of a molecular weight of from 400 to the Md is represented by SA, the area of a molecular weight distribution curve of a molecular weight of from the Md to 5,000,000 by SB, and the area of the region defined by a straight line connecting the apex A (apexA) corresponding to the molecular weight peak MA and the apex B (apexB) corresponding to the molecular weight peak MB and a molecular weight distribution curve by Sd; and heat-fixing said toner image to said recording medium by employing a stationary heater element and a pressure member opposed to said heater element in pressure contact therewith and closely contacting said recording medium and said heater element through a film interposed therebetween.

DESCRIPTION OF THE PREFERRED EMBODIMENTS

The present inventors made intensive studies in order to achieve the objects stated above. As a result, they have discovered that the objects can be achieved when the binder resin contains a THF-insoluble matter in an amount of less than 10 wt. % and also has a specific constitution in respect of the molecular weight distribution measured by GPC of a THF-soluble component.

They have also discovered that the effect of the present invention becomes remarkable when the toner contains a release agent having a specific molecular weight and molecular weight distribution and also has a specific melting point.

They have further discovered that the objects can be better achieved particularly when the binder resin is prepared by mixing a low-molecular weight polymer and a high-molecular weight polymer in a solvent and thereafter removing the solvent.

In regard to the heat-fixing of a toner visible image to a recording medium, they have discovered that the toner is suitable for, besides conventional heat roll fixing devices, a heat fixing system wherein a toner visible image is heat-fixed to a recording medium by means of a stationary heater element and a pressure member opposed to said heater element in pressure contact therewith and closely contacting said recording medium and said heater element through a film interposed therebetween.

The binder resin that constitutes the above toner contains a THF-insoluble (on component) in an amount of less than 10 wt. %, and preferably not less than 5 wt. %, based on the binder resin. A THF-insoluble matter contained in an amount more than 10 wt. % can contribute an improvement in anti-offset but tends to result in a lowering of fixing performance, making it difficult to highly satisfy both.

Figure 2:
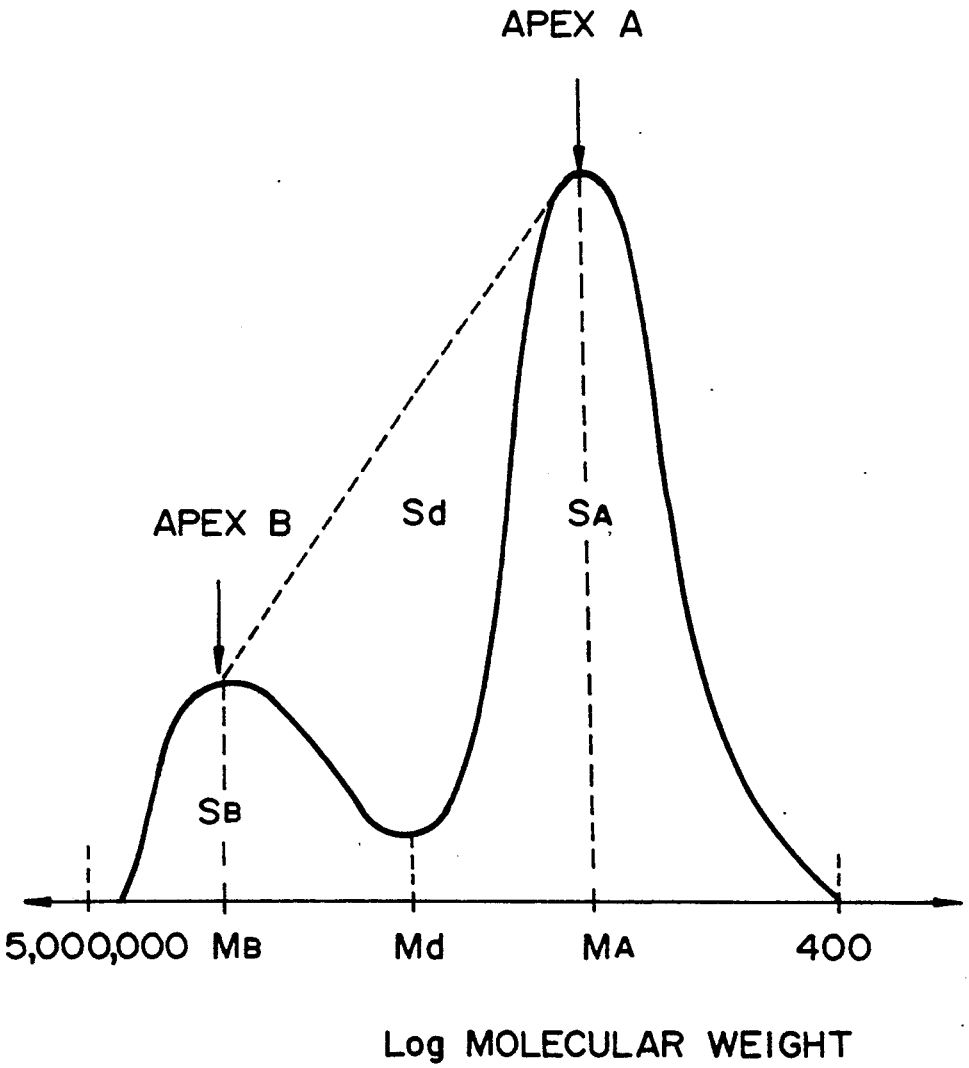
FIG. 2 illustrates a molecular weight distribution curve obtained by GPC.

The binder resin, when its THF-soluble matter is measured by GPC, may preferably have a weight average molecular weight/number average molecular weight ($\overline{M}w/\overline{M}n$) of $\geqq 18$, a molecular weight peak MA in the region of a molecular weight of from 3,000 to 20,000, a molecular weight peak MB in the region of a molecular weight of from 380,000 to 1,000,000, a molecular weight minimum Md in the region of a molecular weight of from 20,000 to 380,000, provided that MB/MA is in the range of from 30 to 150, and a molecular weight distribution curve area ratio SA:SB:Sd of 1:0.3 to 0.8:0.35 to 0.8 when the area of a molecular weight distribution curve of a molecular weight of from 400 to the Md is represented by SA, the area of a molecular weight distribution curve of a molecular weight of from the Md to 5,000,000 by SB, and the area of the region defined by a straight line connecting the apex corresponding to the molecular weight peak MA and the apex corresponding to the molecular weight peak MB and a molecular weight distribution curve by Sd. It is difficult to achieve the objects of the present invention if the above conditions are not satisfied. FIG. 2 shows the results from a GPC chromatogram.

The average molecular weight/number average molecular weight ($\overline{M}w/\overline{M}n$) should be not less than 18, preferably not less than 20, and more preferably in the range of from 25 to 60. If the $\overline{M}w/\overline{M}n$ is less than 18, the fixing performance tends to be improved but the anti-offset is lowered.

The binder resin has one molecular weight peak and another molecular weight peak (MB and MA) in the region of a molecular weight of from 3,000 to 20,000 and in the region of a molecular weight of from 380,000 to 1,000,000, respectively, and a molecular weight minimum in the region of a molecular weight of from 20,000 to 380,000, provided that MB/MA is in the range of from 30 to 150. In a preferred embodiment, the binder resin has one molecular weight peak and another molecular weight peak in the region of a molecular weight of from 5,000 to 15,000 and in the region of a molecular weight of from 450,000 to 900,000, respectively, and a molecular weight minimum in the region of a molecular weight of from 30,000 to 300,000, provided that MB/MA is in the range of from 40 to 100. If it has the molecular weight minimum only in the region of the molecular weight of from 20,000 to 380,000, the fixing performance can be improved but the anti-offset becomes clearly poor. If the molecular weight peak MA is less than 3,000, the blocking resistance becomes poor and tends to cause filming or melt-adhesion to a photosensitive member. On the other hand, if the MA is more than 20,000, the fixing performance may become poor. If the molecular weight peak MB is less than 380,000, the anti-offset becomes poor and tends to bring about a melt-adhered product in a device in the course of grinding. If MB is more than 1,000,000, the fixing performance may become poor, and also the grindability tends to become poor, resulting in a lowering of productivity.

The molecular weight peak ratio MB/MA should be in the range of from 30 to 150, preferably from 30 to 120, and more preferably from 40 to 100.

If the MB/MA is less than 30 or more than 150, it becomes difficult to highly satisfy both the fixing performance and anti-offset.

In the case when two or more molecular weight peaks are present in the region of the molecular weight of from 3,000 to 20,000, the molecular weight corresponding to the position of a higher or highest peak among the peaks in the GPC chromatogram is regarded as the MA.

Similarly, in the case when two or more molecular weight peaks are present in the region of the molecular weight of from 380,000 to 1,000,000, the molecular weight corresponding to the position of a higher or highest peak among the peaks in the GPC chromatogram is regarded as the MB.

In the case when two or more molecular weight minimums are present in the region of the molecular weight of from 20,000 to 380,000, the molecular weight corresponding to the position of a lower or lowest minimum among the molecular weight minimums in the GPC chromatogram is regarded as the Md.

The molecular weight distribution curve area ratio SA:SB:Sd should be 1:0.3 to 0.8:0.35 to 0.8, preferably 1:0.3 to 0.7:0.4 to 0.7, and more preferably 1:0.3 to 0.6:0.5 to 0.7. If the SB is less than 0.3, the anti-offset tends to be lowered, and if it is more than 0.8, the fixing performance and also the grindability tend to become poor. If the Sd is less than 0.35, the fixing performance and/or the anti-offset tend to be lowered, and if it is more than 0.8, the anti-offset tends to become poor.

The release agent preferably used in the toner of the present invention may preferably have a number average molecular weight of not more than 1,000, a weight average molecular weight of not more than 2,500, a weight average molecular weight/number average molecular weight ($\overline{M}w/\overline{M}n$) of not more than 3 and a melting point of from 60° C. to 120° C. In a preferred embodiment, the toner contains a release agent in an amount of from 0.1 wt. % to 20 wt. % based on the binder resin. In a more preferred embodiment, the release agent has a number average molecular weight of from 400 to 700, a weight average molecular weight of from 500 to 1,500, and $\overline{M}w/\overline{M}n$ of not more than 2.5 and a melting point of from 60° C. to 100° C. The release agent may more preferably be contained in an amount of from 1 wt. % to 10 wt. % based on the binder resin.

If the release agent used in the toner of the present invention does not satisfy the above conditions, e.g., if the melting point is higher than 120° C., the fixing performance is adversely affected, and if it is lower than 60° C., the anti-offset and the blocking resistance of the toner are adversely affected. If the release agent is contained in an amount more than 20 wt. %, the blocking resistance and fixing performance tend to be adversely affected when the toner is left in a high-temperature environment, and if it is less than 0.1 wt. %, the effect of preventing offset of toner tends to be insufficient.

The binder resin used in the toner of the present invention may preferably be prepared by mixing in a solvent a polymer A having a weight average molecular weight of from 5,000 to 30,000 and a polymer B having a weight average molecular weight of from 400,000 to 1,500,000 and thereafter removing the solvent. It may more preferably be prepared by mixing in a solvent a polymer A having a weight average molecular weight of from 7,000 to 25,000 and a polymer B having a weight average molecular weight of from 450,000 to 1,000,000 and thereafter removing the solvent. The solvent may be any of those capable of dissolving the polymer A and polymer B. It includes, for example, toluene, xylene and 2-propanol.

In preparing the binder resin used in the toner of the present invention, the polymer A may preferably be prepared by solution polymerization or suspension polymerization, and the polymer B by suspension polymerization or emulsion polymerization. More preferably the polymer A should be prepared by solution polymerization and the polymer B by suspension polymerization.

In order to prepare a uniformly dispersed binder resin, the binder resin may preferably be prepared by mixing the polymers A and B in the solvent and thereafter removing the solvent. It is difficult to obtain a binder resin in a uniformly dispersed state if prepared by a method wherein materials are heated, melted and mixed using a kneader. Such a method makes it difficult to satisfy both the fixing performance and anti-offset as desired in the present invention. It also tends to cause the formation of a melt-adhered product on a photosensitive member or the melt-adhesion of a ground product to the inner wall of a device in the course of grinding, thus being not preferred.

If the polymer A has a weight average molecular weight of less than 5,000, the anti-offset is lowered and the grindability at the time of the manufacture of toners is also lowered. If it has a weight average molecular weight of more than 30,000, the fixing performance is lowered.

If the polymer B has a weight average molecular weight of less than 400,000, the grindability tends to become poor, also undesirably causing a lowering of anti-offset, a lowering of blocking resistance and the formation of a melt-adhered product on a photosensitive member. If it has a weight average molecular weight of more than 1,500,000, the grindability is lowered.

It is difficult to achieve the objects of the present invention when the polymers A and B are each used alone as a binder resin for a toner. The objects can be better achieved by the method in which the polymers A and B are mixed in a solvent and thereafter the solvent is removed than the method in which they are melted and mixed. The polymer B makes it possible to preferably satisfy the mutually conflicting performances such as the anti-offset, the low-temperature fixing performance and the grindability at the time of the manufacture of toners, when the toner is prepared by the method of the present invention.

The THF-insoluble matter referred to in the present invention indicates the weight proportion of a polymer component that has become insoluble to THF (i.e., a giant molecule polymer or a cross-linked polymer) in a resin composition in the toner. The THF-insoluble matter is measured in the following way.

A toner sample is weighed in an amount of from 0.5 to 1.0 g ($W_1$ g), which is then put in a cylindrical filter paper (for example, No. 86R, available from Toyo Roshi K. K.) and set on a Soxhlet extractor. Extraction is carried out for 6 hours using from 100 to 200 ml of THF as a solvent, and the soluble component extracted by the use of the solvent is evaporated, followed by vacuum drying at 100° C. for several hours. Then the THF-soluble resin component is weighed ($W_2$ g). The weight of insoluble components other than the resin components, such as a magnetic material and a pigment contained in the toner, is represented by $W_3$ g. The THF-insoluble matter is determined from the following expression.

$$\text{THF-insoluble matter } (\%) = W_1 - (W_3 + W_2)/(W_1 - W_3) \times 100$$

In the present invention, the molecular weight at the peak and/or shoulder on the chromatogram obtained by GPC (gel permeation chromatography) is/are measured under the following conditions.

Columns are stabilized in a heat chamber heated to 40° C. To the columns kept at this temperature, THF (tetrahydrofuran) as a solvent is flowed at a flow rate of 1 ml per minute, and from 50 to 200 μl of a THF sample solution of a resin prepared to have a sample concentration of from 0.05 to 0.6 wt. % is injected thereinto to make the measurement. In measuring the molecular weight of the sample, the molecular weight distribution ascribed to the sample is calculated from the relationship between the logarithmic value of a calibration curve prepared using several kinds of monodisperse polystyrene standard samples and the count number for flow-out time. As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd., and to use at least about 10 standard polystyrene samples. An RI (refractive index) detector is used as a detector.

Columns may preferably be used in combination of a plurality of commercially available polystyrene gel columns so that the regions of molecular weights of from $10^3$ to $2\times10^6$ can be accurately measured. For example, they may preferably comprise a combination of μ-Styragel 500, $10^3$, $10^4$ and $10^5$, available from Waters Co.; Shodex KF-80M or a combination of KF-802, 803, 804 and 805, available from Showa Denko K. K.; or a combination of TSKgel G1000H, G2000H, G2500H, G3000H, G4000H, G5000H, G6000H, G7000H and GMH, available from Toyo Soda Manufacturing Co., Ltd.

In the working examples as described later, the molecular weight distribution of the binder resin is measured under the following conditions.

Condition for measurement by GPC:

Apparatus: LC-GPC, 150C (Waters Co.)

Column: KF801-KF807 (Showdex Co.)

Column temperature: 28° to 30° C.

Solvent: Tetrahydrofuran (THF)

The molecular weight distribution possessed by a sample is calculated from the relation between a logarithmic value, measured under the above conditions, of a calibration curve prepared using a polystyrene standard sample and the number of moieties measured under the above conditions.

The SA, SB and Sd of the molecular weight distribution curve in the binder resin used in the toner of the present invention are determined by calculating the weight ratios of a sample cut out from a chromatogram obtained by GPC and calculating the area ratios thereof.

In the working examples as described later, the molecular weight distribution of the release agent is measured by GPC (gel permeation chromatography) under the following conditions.

Apparatus: LC-GPC, 150C (Waters Co.)

Column: GMH6 (Toyo Soda Manufacturing Co., Ltd.), 60 cm

Column temperature: 140° C.

Solvent: o-dichlorobenzene

The molecular weight distribution possessed by a sample is calculated from a polyethylene standard.

In the present invention, the melting point of the release agent is measured using a differential scanning calorimeter DSC-7 (manufactured by Perkin-Elmer Co.) to determine an endothermic peak of the sample, which peak is regarded as a maximum melting peak value.

Figure 5:
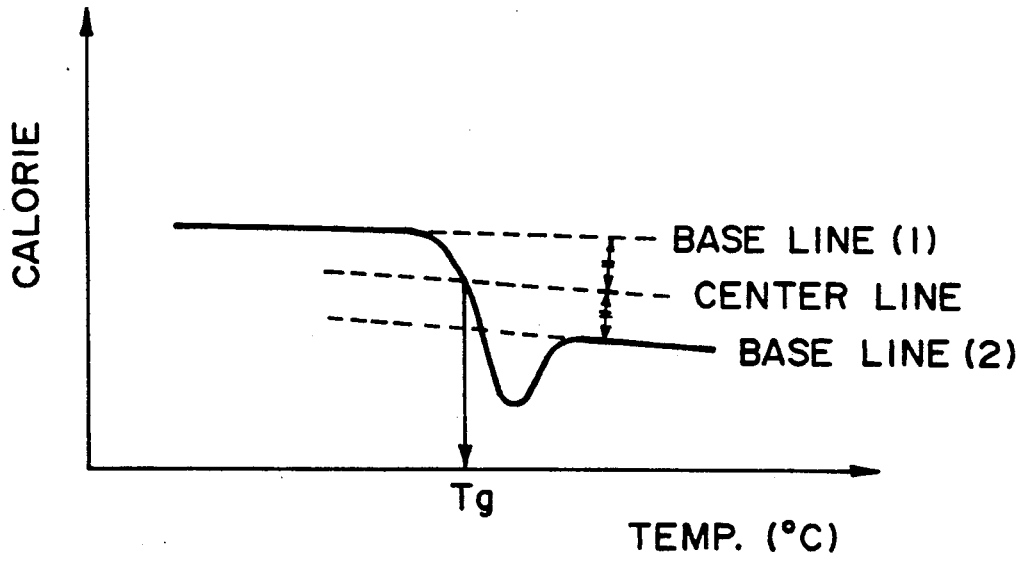
FIG. 5 illustrates a DSC curve for determining Tg using a DSC (differential scanning calorimeter).

FIG. 5 shows an example of the endothermic peak in the DSC.

In the toner of the present invention, the binder resin may preferably contain i) two kinds of styrene-acrylate copolymers, a low-temperature softening resin and a high-temperature softening resin, and ii) a low-melting graft-modified polyolefin release agent.

The low-temperature softening resin may have an Mw of from $5.0\times10^3$ to $3.0\times10^4$, and preferably from $5.0\times10^3$ to $2.0\times10^4$, a ratio of Mw to Mn (Mw/Mn) of not more than 3.0, a flow-out point (herein the temperature at which the resin begins to flow out) in a flow tester, of from 75° C. to 90° C., a softening point of from 80° C. to 110° C., and a glass transition point (hereinafter "Tg") of from 55° C. to 70° C., preferably from 55° C. to 65° C. The high-temperature softening resin may have an Mw of from $4.0\times10^5$ to $1.5\times10^6$, an Mw/Mn of not more than 3.0, a flow-out point of from 110° C. to 160° C., a softening point of from 150° C. to 230° C., and Tg of not less than 55° C.

If the Mw of the low-temperature softening resin is less than $5.0\times10^3$, the blocking resistance of the toner may be seriously deteriorated, the storage stability may be damaged, and the phenomenon of melt-adhesion of the toner to a photosensitive member may occur at the time of development to tend to adversely affect fixed images. If the Mw is more than $3.0\times10^4$, it becomes difficult to achieve the desired low-temperature fixing performance, which also results in an increase in the power consumption required for the fixing of the toner to a recording medium. When the Mw/Mn of the low-temperature softening resin is controlled to be not more than 3.0, the low-temperature fixing performance can be improved.

If the flow-out point of the low-temperature softening resin in a flow tester is lower than 75° C., the blocking resistance of the toner may be seriously deteriorated. On the other hand, if it is higher than 90° C., it becomes difficult to achieve the low-temperature fixing performance when used in combination with the high-temperature softening resin.

If the softening point of the low-temperature softening resin is lower than 80° C., an excessive melt-adhesion of the toner tends to occur in the step of heat fixing even when used in combination with the high-temperature softening resin. Such excessive melt-adhesion tends to bring about the disadvantages that fixed-image surfaces become glossy, toner materials penetrate into or strike through a recording medium such as transfer paper, and images are blurred because of the spread of a molten toner. If the softening point is higher than 110° C., it becomes difficult to achieve low-temperature fixing performance, also resulting in an increase in power consumption required for the fixing of the toner to a recording medium.

Use of the specific low-temperature softening resin as described above enables achievement of good low-temperature fixing performance.

On the other hand, as a result of intensive studies made by the present inventors on the offset phenomenon, the low-temperature softening resin was found to be preferably contained in an amount of not less than 50 wt. %, more perferably not less than 65 wt. %, and most preferably not less than 70 wt. %, based on the total weight of the binder resin, in order to bring out the low-temperature fixing performance attributable to the low-temperature softening resin component.

The high-temperature softening resin is desined to prevent the offset phenomenon by its addition of a very small amount.

It has been made clear that the resin used in combination with the above low-temperature softening resin for the purpose of preventing the offset phenomenon must be the high-temperature softening resin extremely different in molecular weight and melt viscosity characteristics from the low-temperature softening resin.

In the present invention, if the Mw of the high-temperature softening resin is less than $4.0\times10^5$, the offset phenomenon tends to occur when this resin is used in combination with the low-temperature softening resin in such a proportion that enables low-temperature fixing. On the other hand, if the Mw is more than $1.5\times10^6$, the low-temperature fixing performance tends to be damaged.

If the flow-out temperature of the high-temperature softening resin in a flow tester is lower than 110° C. or the softening point is lower than 150° C., the offset phenomenon tends to occur when this resin is used in combination with the low-temperature softening resin in such a proportion that enables low-temperature fixing. On the other hand, if the flow-out temperature is higher than 160° C. or the softening point is higher than 230° C., the low-temperature fixing performance tends to be damaged.

The high-temperature softening resin may have a Tg of not lower than 55° C., preferably from 60° C. to 70° C., and more preferably form 65° C. to 70° C. This is due to the fact that when materials are melt-kneaded in the manufacture of toners, polymeric molecular chains are cut to decrease the molecular weight of the polymeric component, and hence, if the Tg is lower than 55° C., the melt-adhesion of the toner to a photosensitive member tends to occur at the time of development.

The low-temperature softening resin and high-temperature softening resin contained in the binder resin may be in a proportion ranging from 50:50 to 90:10, preferably 65:35 to 90:10, in wt. %.

If the amount of the low-temperature softening resin is less than 50 wt. % and also the amount of the high-temperature softening resin is more than 50 wt. %, it becomes difficult to achieve the low-temperature fixing performance. On the other hand, if the amount of the low-temperature softening resin is more than 90 wt. % and the amount of the high-temperature softening resin is less than 10 wt. %, the offset phenomenon tends to adversely affect fixed images.

If the amount of the low-temperature softening resin is more than 50 wt. %, grindability when the toner is prepared tends to be seriously lowered to reduce production efficiency of the toner.

An additional feature in the constitution of the toner of the present invention is that the low-temperature softening resin of the binder resin is obtained by solution polymerization, and the high-temperature softening resin by suspension polymerization, where both are mixed in a solvent capable of dissolving each resin.

Suspension polymerization and emulsion polymerization are available for obtaining high-temperature softening resin having molecular weight distribution and melt viscosity characteristics as described above. In emulsion polymerization, however, it is difficult to prevent an emulsifying agent from remaining, thus resulting in a lowering of toner characteristics.

It is preferred for the low-temperature softening resin to be synthesized by solution polymerization taking account of its solution mixture with the high-temperature softening resin, carried out after completion of the polymerization.

The mixing of the low-temperature softening resin and the high-temperature softening resin is accomplished through solution mixing. Other mixing methods can not achieve uniform mixture to adversely affect toner characteristics.

The solution mixing makes it possible to remove remaining monomers when the step of removing the solvent is taken.

Figure 3:
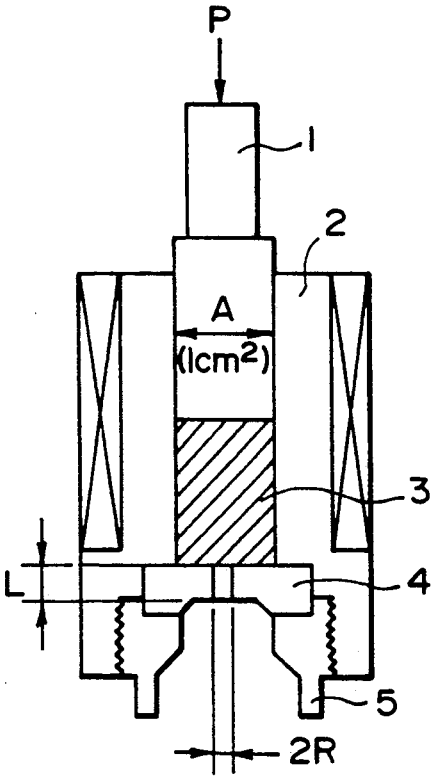
FIG. 3 is a schematic illustration of an overhead-type flow tester.

The melting characteristics of the binder resin can be measured using an overhead-type flow tester as illustrated in FIG. 3 (Shimadzu Flow Tester CFT-500 Type). In the first place, about 1.0 g of a sample 3 molded by use of a pressure molder is extruded from a nozzle 4 of 1 mm in diameter and 1 mm in length under application of a load of 20 kgf using a plunger 1 at a temperature rising rate of 5.0° C./min, during which the fall quantity of the plunger of the flow tester is measured.

Figure 4:
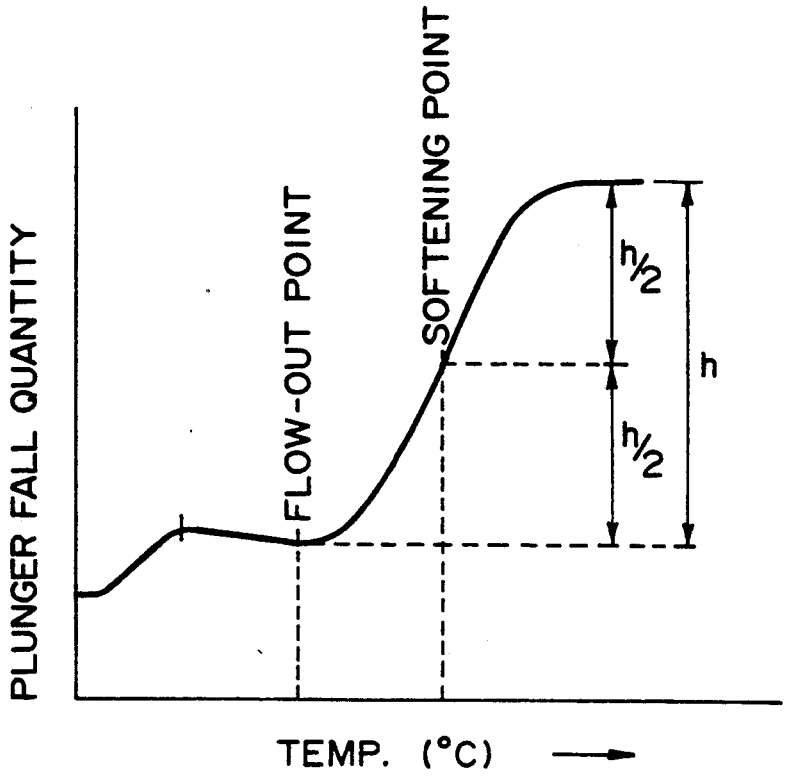
FIG. 4 shows a flow tester flow-out curve (a plunger fall quantity-temperature curve).

Here, when the height of an S-shaped curve in the plunger fall quantity-temperature curve of the flow tester (see the flow tester flow-out curve shown in FIG. 4) is represented by "h", the temperature at a point of h/2 is regarded as the softening point and the temperature at which the sample begins to flow outward is regarded as the flow-out point or temperature.

The Tg is measured in the following way: Using a DSC curve obtained at the time of the second temperature rise, the temperature corresponding to the position of the point at which, as shown in FIG. 5, the center line between a base line (1) before the endothermic peak and a base line (2) after the endothermic peak intersects the rising curve is regarded as the Tg.

The Tg in the present invention is measured using a differential scanning calorimeter DSC-7 (manufactured by Perkin-Elmer Co.), at a temperature rising rate of 10° C./min and according to ASTM (D3418-82).

The resin composition in the toner of the present invention may preferably be that obtained by polymerizing at least one kind of monomer selected from styrenes, acrylic acids, methacrylic acids and derivatives thereof. These are preferable in view of development properties and triboelectric properties. As for examples of monomers that can be used, the styrenes include styrene, α-methylstyrene, vinyltoluene, and chlorostyrene. The acrylic acids, methacrylic acids and derivatives thereof include acrylic acid and acrylates such as methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, and dimetylaminoethyl acrylate; methacrylic acid and methacrylates such as methyl methacrylate, ethyl methacrylate, propyl methacrylate, butyl methacrylate, amyl methacrylate, hexyl methacrylate, 2-ethylhexyl methacrylate, octyl methacrylate, decyl methacrylate, dodecyl methacrylate, lauryl methacrylate, cyclohexyl methacrylate, phenyl methacrylate, 2-hydroxyethyl methacrylate, 2-hydroxypropyl methacrylate, dimethylaminoethyl methacrylate, glycidyl methacrylate, and stearyl methacrylate.

Besides the above monomers, other monomers may be used in a small amount so long as the objects of the present invention can be achieved, which include, for example, acrylonitrile, 2-vinylpyridine, 4-vinylpyridine, vinylcarbazole, vinyl methyl ether, butadiene, isoprene, maleic anhydride, maleic acid, maleic acid monoesters, maleic acid diesters, and vinyl acetate.

A cross-linking agent may be used in the toner of the present invention, and a bifunctional cross-linking agent can be used, which includes, divinylbenzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, respectively, dipropylene glycol diacrylate, polypropylene glycol diacrylate, polyester type diacrylate (MANDA, available from Nippon Kayaku Co., Ltd.), and those in which the acrylate units of the above acrylate type cross-linking agents have been respectively replaced with methacrylate units.

A polyfunctional cross-linking agent can also be used, which includes pentaerythritol triacrylate, trimethylolethane triacrylate, trimethylolpropane triacrylate, tetramethylolmethane tetraacrylate, oligoester acrylate and methacrylate thereof, 2,2-bis(4-methacryloxy, polyethoxyphenyl)propane, diallyl phthalate, triallyl cyanurate, triallyl isocyanurate, triallyl isocyanurate, triallyl trimellitate, and diaryl chlorendate.

Preferably, these cross-linking agents need not be incorporated so that the THF-insoluble matter is controlled to less than 10 wt. %. In the case where the cross-linking agent is incorporated, it should be used in an amount of less than 1 wt. %, preferably not more than 0.5 wt. %, and more preferably not more than 0.2 wt. %.

The binder resin used in the toner of the present invention is synthesized from monomers in the presence or absence of the cross-linking agent and also with use of a polymerization initiator.

The polymerization initiator may include di-t-butyl peroxide, benzoyl peroxide, lauroyl peroxide, t-butyl peroxylaurate, 2,2'-azobisisobutyronitrile, 1,1-bis(t-butylperoxy)-3,3,5-trimethylcyclohexane, 1,1-bis(t-butylperoxy)cyclohexane, 1,1-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy)hexane, 2,5-dimethyl-2,5-di(t-butylperoxy) hexyne-3, 2,5-dimethyl-2,5-di(benzoylperoxy)hexane, di-t-butylperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-diemthyl-2,5-di(t-butylperoxy)hexane, diethylene glycol-bis(t-butylperoxycarbonate), di-t-butylperoxytrimethyladipate, tris(t-butylperoxy) triazine, and vinyl tris(t-butylperoxy)silane.

The above polymerization initiators may be used alone or by mixture taking account of the amount, the polymerization temperature and the half-life period.

In the toner used in the present invention, at least one kind of a release agent having a number average molecular weight ($\overline{M}n$) of not more than $1.0\times10^3$, a weight average molecular weight ($\overline{M}w$) of not more than $2.5\times10^3$, an $\overline{M}w/\overline{M}n$ of not more than 3.0, and a melting point (mp) of from 60° C. to 120° C. The release agent may preferably be used in amount of from 0.1 to 20 wt. %, and preferably from 1 to 10 wt. %, based on the binder resin.

Release agents preferably used in the toner of the present invention include, for example, paraffin wax, a low-molecular weight polyethylene wax, a low-molecular weight ethylene-propylene copolymer, a low-molecular weight polypropylene wax, and a polyolefin wax graft-modified with an aromatic vinyl monomer such as styrene and styrene derivatives, an unsaturated fatty acid or an unsaturated fatty acid ester. Of these, the graft-modified polyolefin wax is particularly preferred from the viewpoint of the advantages that the lifetime of developers and of machines such as copying machines making use of the developers can be extended and the machines can be made maintenance-free.

The graft-modified polyolefin wax may have an Mn of not more than $1.0\times10^3$, and preferably from 400 to 700, an Mw of not more than $2.5\times10^3$, and preferably from 700 to 1,500, an Mw/Mn of not more than 3.0, and preferably not more than 2.0, and a melting point of from 60° C. to 120° C., and preferably from 60° C. to 100° C.

Use of this release agent makes it possible to carry out the heat fixing of the toner to a recording medium under fixing conditions of low temperatures without causing offset, and thus to achieve a lower power consumption.

Intensive studies made by the present inventors have revealed that what is required is a release agent which renders good release properties at a low temperature with respect to the low-temperature melting binder resin which enables the low-temperature fixing; that the temperature at which the release agent renders release properties correlates with the melting point of the release agent; and that a release agent having a lower melting point is more advantageous for the low-temperature fixing. When, however, a release agent with a low melting point is used, the release agent makes poor the blocking resistance of a toner and has an ill influence that the filming of toner to a carrier occurs when the product is used in two-component type development. Accordingly, in the present invention, the release agent is made to have the molecular weight distribution which is relatively sharp as described above, so that the blocking resistance can be improved, the release agent can render release properties at a lower temperature, and good performance without causing offset phenomenon can be obtained.

However, although the low-temperature fixing can be achieved to a certain extent when the release agent with a low melting point and binder resin as described above are used in combination, it is technically difficult to disperse the release agent in the mixed resin comprised of the low-temperature softening resin and the high-temperature softening resin. An insufficient dispersion adversely affects the developing performance of toner.

The present inventors made further intensive studies discovering that the above problems can be eliminated and a good development performance and further low-temperature fixing performance can be achieved when low-melting polyolefin wax is graft-modified in order to improve the dispersion of the release agent in the binder resin as described above.

The binder resin in the toner of the present invention may preferably be obtained by mixing the low-temperature softening resin and the high-temperature softening resin, and both the resins may preferably be binder resins comprising the same components.

The low-melting graft-modified polyolefin release agent used in the present invention may include a polyolefin wax graft-modified with an aromatic vinyl monomer such as styrene and styrene derivatives, or an unsaturated fatty acid or an unsaturated fatty acid ester.

The polyolefin wax may include polyethylene waxes; homopolymers of α-olefins such as propylene, 1-butene, 1-hexene, 1-decene, and 4-methyl-1-pentene; copolymers of two or more kinds of α-olefins; and copolymers of ethylene with an α-olefin. It may further include oxides of polyolefins.

The unsaturated fatty acid or unsaturated fatty acid ester used for synthesizing the graft-modified polyolefin may include methacrylic acid; methacrylates such as methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate; acrylic acid; acrylates such as methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate, and 1,4-butanediol diacrylate; maleic acid, fumaric acid, itaconic acid, citraconic acid, and unsaturated dibasic acid esters such as monoethyl maleate, diethyl maleate, monopropyl maleate, dipropyl maleate, monobutyl maleate, dibutyl maleate, di-2-ethylhexyl maleate, monoethyl fumarate, diethyl fumarate, dibutyl fumarate, di-2-ethylhexyl fumarate, monoethyl itaconate, diethyl itaconate, monoethyl citraconate, and diethyl citraconate. These can be used alone or in combination of two or more kinds.

The aromatic vinyl monomer may include styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene, and p-chlorostyrene. These can be used alone or in combination of two or more kinds.

The polyolefin can be graft-modified using conventionally known methods. For example, a reaction of the polyolefin with the aromatic vinyl monomer and the unsaturated fatty acid or unsaturated fatty acid ester which are in a molten state or dissolved in a solvent may be conducted by heating in the atmosphere or under application of pressure and in the presence of a radical initiator. A graft-modified polyolefin can be thus obtained. The grafting using the aromatic vinyl monomer and the unsaturated fatty acid or unsaturated fatty acid ester may be carried out using both at the same time or may be carried out using them separately.

The initiator used in the grafting reaction may include benzoyl peroxide, dichlorobenzoyl peroxide, di-tert-butyl peroxide, lauroyl peroxide, tert-butyl perphenyl acetate, cumine pivarate, azobisisobutylonitrile, dimethylazoisobutyrate, and dicumyl peroxide.

As to the proportion of the grafting agent to the polyolefin, the former may preferably be in an amount of from 0.1 part by weight to 100 parts by weight, and more preferably from 1 part by weight to 50 parts by weight, based on 100 parts by weight of the latter. An amount less than 0.1 part by weight can not bring about little effect of grafting, and an amount more than 100 parts by weight may result in loss of advantageous properties inherent in the polyolefin.

The aromatic vinyl monomer and the unsaturated fatty acid or unsaturated fatty acid ester may be used preferably in a weight ratio of from 95:5 to 5:95, and more preferably from 80:20 to 20:80. An excessive amount for the unsaturated fatty acid or unsaturated fatty acid ester tends to result in a decrease in the releasing effect inherent in the polyolefin. An excessive amount for the aromatic vinyl monomer can not bring about great improvement in the dispersibility of the polyolefin in the toner.

The graft-modified polyolefin used in the present invention may preferably be added in an amount of from 0.1 part by weight to 20 parts by weight, and more preferably from 0.5 part by weight to 10 parts by weight, based on 100 parts by weight of the binder resin. An amount less than 0.1 part by weight makes it difficult to bring about a sufficient releasing effect, and an amount more than 20 parts by weight tends to result in a lowering of the blocking resistance of the toner.

The graft-modified polyolefin used in the present invention may preferably have a melt viscosity in the range of from 1 to 250 cps (centipoise) at 160° C. A melt viscosity less than 1 cps tends to cause the blocking of toner. A melt viscosity more than 250 cps makes it hard for the modified polyolefin to bleed from the toner and makes it hard for the releasing effect to be exhibited. In the fixing method of the present invention, it is preferred that in general a releasable component having a lower melt viscosity is used when a lower fixing temperature is selected.

The melt viscosity referred to in the present invention is based on a value measured with a Brookfield type viscometer.

The toner used in the present invention may contain at least one kind of release agent having a melting point of higher than 120° C. so long as used in such an amount that may not adversely affect the fixing performance of the toner.

The toner of the present invention may contain a charge control agent. Conventionally known positive or negative charge control agents can be used as the charge control agent. The charge control agent may include the following:

(1) Those capable of controlling the toner to have positive charge may include the following materials: Nigrosine, azine dyes containing an alkyl group having 2 to 16 carbon atoms (Japanese Patent Publication No. 42-1627), basic dyes as exemplified by C.I. Basic Yellow 2 (C.I.41000), C.I. Basic Yellow 3, C.I. Basic Red 1 (C.I.45160), C.I. Basic Red 9 (C.I.42500), C.I. Basic Violet 1 (C.I.42535), C.I. Basic Violet 3 (C.I.42555), C.I. Basic Violet 10 (C.I.45170), C.I. Basic Violet 14 (C.I.42510), C.I. Basic Blue 1 (C.I.42025), C.I. Basic Blue 3 (C.I.51005), C.I. Basic Blue 5 (C.I.42140), C.I. Basic Blue 7 (C.I.42595), C.I. Basic Blue 9 (C.I.52015), C.I. Basic Blue 24 (C.I.52030), C.I. Basic Blue 25 (C.I.52025), C.I. Basic Blue 26 (C.I.44025), C.I. Basic Green 1 (C.I.42040) and C.I. Basic Green 4 (C.I.42000), lake pigments of these basic dyes (laking agents are exemplifeied by tungstophosphoric acid, molybdophosphoric acid, tungstomolybdophosphoric acid, tannic acid, lauric acid, gallic acid, ferricyanides, and ferrocyanides), C.I. Solvent black 3 (C.I.26150), Hanza Yellow G (C.I.11680), C.I. Mordant Black 11, C.I. Pigment Black 1, benzoylmethyl-hexadecylammonium chloride, decyl-trimethylammonium chloride, dialkyltin compounds such as dibutyltin and dioctyltin, metal salts of higher fatty acids, inorganic fine powders such as zinc oxide, metal complexes of EDTA or acetylacetone, and polyamine resins such as vinyl polymers containing an amino group and condensed polymers containing an amino group. Nigrosine, metals salts of higher fatty acids, and vinyl polymers containing an amino group are particularly preferred from the viewpoint of dispersibility.

(2) Those capable of controlling the toner to have negative charge may include the following materials: Metal compounds of monoazo dyes, as disclosed in Japanese Patent Publications No. 41-20153, No. 42-27596, No. 44-6397 and No. 45-26478, nitramines and salts thereof, as disclosed in Japanese Patent Application Laid-open No. 50-133338, dyes or pigments such as C.I. 14645, metal-containing compounds formed by the union of Zn, Al, Co, Cr or Fe with salicylic acid, naphthoic acid or dicarboxylic acid, as disclosed in Japanese Patent Publications No. 55-42752, No. 58-41508, No. 58-7384 and No. 59-7384, sulfonated copper phthalocyanine pigments, styrene oligomers into which a nitro group or halogen has been introduced, and chlorinated paraffins. Metal-containing compounds of monoazo dyes, and metal-containing compounds of salicylic acid, alkylsalicylic acid, naphthoic acid or dicarboxylic acid are particularly preferred from the viewpoint of dispersibility.

The toner of the present invention may also be optionally incorporated with additives to obtain good results. The additives may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); fluidity-providing agents such as colloidal silica and aluminum oxide (in particular, hydrophobic colloidal silica is preferred); anti-caking agents; and conductivity-providing agents such as carbon black, zinc oxide, antimony oxide and tin oxide. It is also possible to use as a developability improver, a small amount of white fine particles and black fine particles having the polarity opposite to the charge polarity of the toner.

The toner of the present invention may also be used in the form of a mixture with carrier powder, when used as a two-component type developer. In this instance, the toner and the carrier powder may be mixed in such a ratio that gives a toner concentration of from 0.1 to 50 wt. %, preferably from 0.5 to 10 wt. %, and more preferably from 3 to 5 wt. %.

As the carrier powder usable in the present invention, it is possible to use known materials. They include, for example, powders having magnetic properties, such as iron powder, ferrite powder and nickle powder, glass beads, and glass beads whose surfaces have been treated with a resin such as a fluorine resin or a silicone resin.

The toner of the present invention may further contain a magnetic material so that it can be used as a magnetic toner. In this instance the magnetic material serves as a coloring agent at the same time. The magnetic material contained in the toner may include iron oxides such as magnetite, hematite and ferrite, or compounds of divalent metals with iron oxide; metals such as iron, cobalt and nickel, or alloys of any of these metals with any of metals such as aluminum, cobalt, copper, lead, magnesium, tin, zinc, antimony, beryllium, bismuth, cadmium, calcium, manganese, selenium, titanium, tungsten and vanadium, and mixture of any of these.

These ferromagnetic materials may preferably be those having an average particle diameter of from 0.1 μm to 2 μm, and more preferably from 0.1 μm to 0.5 μm. Spherical materials are particularly preferred. The magnetic material may be contained in the magnetic toner in an amount of from about 20 to 200 parts by weight based on 100 parts by weight of the resin component, and particularly preferably from 40 to 180 parts by weight based on 100 parts by weight of the resin component.

The toner of the present invention may also optionally contain a colorant.

As the colorant used in the toner of the present invention, a pigment or a dye may be used. The pigment may include carbon black, Aniline Black, acetyrene black, Naphtol Yellow, Hanza Yellow, Rhodamine Lake, Alizarin Lake, red iron oxide, Phthalocyanine Blue and Indanthrene Blue. The pigment is used in such an amount that is necessary and sufficient for maintaining the optical density of fixed images, and should be added preferably in an amount of from 0.1 part by weight to 20 parts by weight, and more preferably from 2 to 10 parts by weight, based on 100 parts by weight of the resin.

The dye may include azo dyes, anthraquinone dyes, xanthene dyes and methine dyes. The dye should be added preferably in an amount of from 0.1 part by weight to 20 parts by weight, and more preferably from 0.3 part by weight to 3 parts by weight, based on 100 parts by weight of the resin.

The toner according to the present invention for developing an electrostatic latent image may be prepared by a method comprising thoroughly mixing the resin composition according to the present invention, the release agent and the charge control agent optionally together with the magnetic material, the pigment or dye as a coloring agent and other additives by means of a mixing machine such as a ball mill, thereafter melting and kneading the mixture by the use of a heat kneading machine such as a heating roll, a kneader or an extruder so that resins are mutually compatibilized and the pigment or dye is dispersed and dissolved therein, and cooling the resulting product to effect solidification, followed by crushing, pulverization and then strict classification to give a toner with an average particle diameter of from 3 μm to 20 μm.

The present invention also relates to a method of heat-fixing a toner visible image, wherein the method comprises heat-fixing the toner image formed using the toner having the characteristic features as described above, to a recording medium by means of a heater element stationarily supported and a pressure member that stands opposite to said heater element in pressure contact and brings said recording medium into close contact with said heater element through a film interposed between them.

Figure 1:
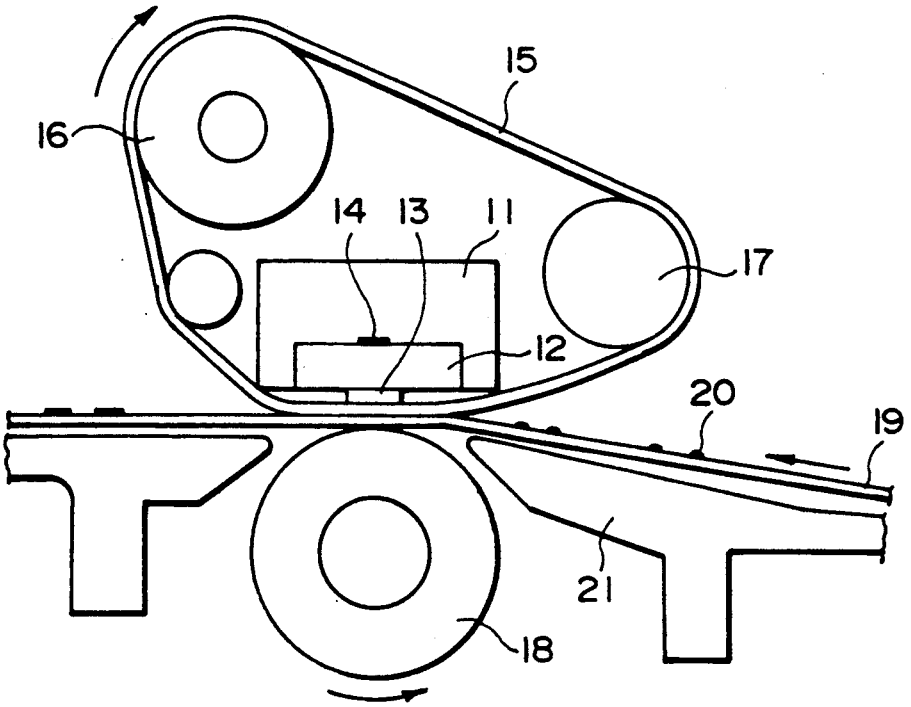
FIG. 1 is a schematic illustration of an example of a fixing device used for carrying out the fixing method of the present invention.

FIG. 1 illustrates the construction of the fixing device used in the present invention. The fixing method of the present invention is by no means limited only to the method embodied in it.

In the fixing device shown in FIG. 1, a heater element 11 has a smaller heat capacity than conventional heat rolls, and has a linear heating part. The heating part may preferably be made to have a maximum temperature of from 100° C. to 300° C.

A film 15 is interposed between the heater element 11 and a pressure member 18, and may preferably comprise a heat-resistant sheet of from 1 to 100 μm in thickness. Heat-resistant sheets that can be used therefor may include sheets of polymers having high heat-resistance, such as polyester, PET (polyethylene terephthalate), PFA (a tetrafluoroethylene/perfluoroalkyl vinyl ether copolymer), PTFE (polytetrafluoroethylene), polyimide and polyamide, sheets of metals such as aluminum, and laminate sheets comprised of a metal sheet and a polymer sheet.

In a preferred constitution of the film, these heat-resistant sheets have a release layer and/or a low-resistance layer.

The numeral 11 denotes a low heat capacitance linear heater element stationarily supported in the fixing device. An example thereof comprises an alumina substrate 12 of 1.0 mm in thickness, 10 mm in width and 240 mm in longitudinal length and a resistance material 13 coated thereon to have a width of 1.0 mm, which is electrified from the both ends in the longitudinal direction. The electricity is applied under variations of pulse widths of the pulses corresponding with the desired temperatures and energy emission quantities which are controlled by a temperature sensor 14, in the pulse-like waveform with a period of 20 msec of DC 100 V. The pulse widths range approximately from 0.5 msec to 5 msec. In contact with the heater element 11 the energy and temperature of which have been controlled in this way, a fixing film 15 moves in the direction of the arrow shown in the drawing. An example of this fixing film includes an endless film comprised of a heat-resistant sheet of 20 μm thick (comprising, for example, polyimide, polyetherimide, PES, or PFA) and a release layer (comprising a fluorine resin such as PTFE or PFA to which a conductive material is added) coated at least on the side coming into contact with the image to have a thickness of 10 μm. In general, the total thickness of the film may preferably be less than 100 μm, and more preferably less than 40 μm. The film is moved in the direction of the arrow in a wrinkle-free state by the action of the drive of, and tension between, a drive roller 16 and a follower roller 17.

The numeral 18 denotes a pressure roller having on its surface an elastic layer of rubber with good release properties as exemplified by silicone rubber. This pressure roller is pressed against the heater element at a total pressure of 4 to 20 kg through the film interposed between them and is rotated in pressure contact with the film. Toner 20 having not been fixed on a transferring medium 19 is led to the fixing zone by means of an inlet guide 21. A fixed image is thus obtained by the heating described above.

The above has been described with reference to an embodiment in which the fixing film comprises an endless belt. A sheet-feeding shaft and a wind-up shaft may also be used, and the fixing film may not be endless.

The image forming apparatus includes an apparatus that forms an image by the use of a toner, as exemplified by copying machines, printers, and facsimile apparatus, to which the present fixing device can be applied.

When the temperature detected by the temperature sensor 14 in the low heat capacitance linear heater element 11 is $T_1$, the surface temperature $T_2$ of the film 15 opposed to the resistance material 13 is about 10° to 30° C. lower than $T_1$. The surface temperature $T_3$ of the film on the part at which the film 15 is peeled from the toner-fixed face is a temperature substantially equal to the above temperature $T_2$.

Suitable as methods of electrifying the heater element according to such a temperature control system are the pulse width modulation system, the frequency modulation system, the AC phase control system, etc.

The present invention will be described below in greater detail by giving synthesis examples and working examples. The "part(s)" in the synthesis examples and working examples refers to "part(s) by weight".

SYNTHESIS EXAMPLE 1

In a reaction vessel, 200 parts of cumene was put, and the temperature was raised to the reflux temperature. A mixture of 100 parts of styrene monomer and 6 parts of di-tert-butyl peroxide was dropwise added thereto at 135° C. in 4 hours. Under further reflux of cumene (146° C. to 156° C.), the solution polymerization was completed and then the cumene was removed. The polystyrene thus obtained was soluble in THF, and had a weight average molecular weight of 7,800, a molecular weight peak (MA) of 7,200 and a Tg of 67° C. This is designated as polymer A-1 of the binder resin for the toner of the present invention.

SYNTHESIS EXAMPLES 2 to 5

Using the monomer compositions, polymerization initiators and solvents as shown in Table 1, the solution polymerization was carried out in the same manner as in Synthesis Example 1 to give polymers A-2 to A-5 of the binder resin for the toner of the present invention.

TABLE 1

Syntheses of Polymers A

| Polymer | Monomer composition (parts) | Solvent | Polymlzn. initiator |
|---|---|---|---|
| Synthesis Example: | | | |
| 2 A-2 | Styrene (85)<br>Butyl acrylate (15) | Xylene | Benzoyl peroxide |

TABLE 1-continued

| Syntheses of Polymers A | | | |
|---|---|---|---|
| 3 A-3 | Styrene (80)<br>Butyl acrylate (20) | Xylene | Benzoyl peroxide |
| 4 A-4 | Styrene (77)<br>2-Ethylhexyl acrylate (23) | Toluene | Benzoyl peroxide |
| 5 A-5 | Styrene (80)<br>2-Ethylhexyl acrylate (20) | Toluene | Benzoyl peroxide |

| Polymer | Weight average molecular weight | Molecular weight peak | Tg |
|---|---|---|---|
| A-2 | 11,000 | 9,200 | 62° C. |
| A-3 | 17,000 | 15,600 | 62° C. |
| A-4 | 21,000 | 19,200 | 57° C. |
| A-5 | 24,000 | 22,300 | 64° C. |

SYNTHESIS EXAMPLE 6

In a reaction vessel, 200 parts of deaerated water in which 0.1 part of a partially saponified product of polyvinyl alcohol was dissolved was put, and then the monomer composition as shown in Table 2 was added thereto to make up a suspension. The suspension was heated to 80° C. in a nitrogen atmosphere. The suspension was maintained at that temperature for 24 hours, and then polymerization was completed. After the reaction mixture was cooled to room temperature, spherical polymer particles produced as a result of the polymerization were filtered, and then thoroughly washed with water, followed by dehydration and drying to give polymer B-1 of the binder resin for the toner of the present invention. The polymer had a weight average molecular weight of 452,000, a molecular weight peak of 433,000 and a Tg of 57° C.

TABLE 2

| Monomer Composition | Mixing proportion |
|---|---|
| Styrene | 72 parts |
| Methyl methacrylate | 10 parts |
| Butyl acrylate | 18 parts |
| Benzoyl peroxide | 0.22 part |

SYNTHESIS EXAMPLES 7 to 10

Using the monomer compositions and polymerization initiators as shown in Table 3, the suspension polymerization was carried out in the same manner as in Synthesis Example 6 to give polymers B-2 to B-5 of the binder resin for the toner of the present invention.

TABLE 3

| Syntheses of Polymers B | | |
|---|---|---|
| Polymer | Monomer composition (parts) | Polymerization initiator |
| Synthesis Example: | | |
| 7 B-2 | Styrene (83)<br>Butyl acrylate (17) | Benzoyl peroxide |
| 8 B-3 | Styrene (85)<br>Butyl acrylate (15) | Benzoyl peroxide |
| 9 B-4 | Styrene (77)<br>2-Ethylhexyl acrylate (23) | 1,1'-azobis (cyclohexane-1-carbonitrile) |
| 10 B-5 | Styrene (80)<br>Butyl acrylate (20)<br>Divinylbenzene (0.02) | Benzoyl peroxide |

| Polymer | Weight average molecular weight | Molecular weight peak | Tg |
|---|---|---|---|
| B-2 | 603,000 | 583,000 | 64° C. |
| B-3 | 827,000 | 804,000 | 67° C. |
| B-4 | 956,000 | 928,000 | 66° C. |

TABLE 3-continued

| Syntheses of Polymers B | | | |
|---|---|---|---|
| B-5 | 751,000 | 692,000 | 60° C. |

The weight average molecular weight (Mw), Mw/Mn, flow-out point, softening point and Tg of each of the above polymers A-1, A-2, A-3, A-4, A-5, B-1, B-2, B-3, B-4 and B-5 are shown in Table 4 below.

TABLE 4

| Polymer | Mw | Mw/Mn | Flow-out point (°C.) | Softening point (°C.) | Tg (°C.) |
|---|---|---|---|---|---|
| A-1 | 7,800 | 2.4 | 85 | 105 | 67 |
| A-2 | 11,000 | 2.4 | 85 | 102 | 62 |
| A-3 | 17,000 | 2.2 | 87 | 105 | 62 |
| A-4 | 21,000 | 2.3 | 87 | 106 | 57 |
| A-5 | 24,000 | 2.2 | 90 | 110 | 64 |
| B-1 | 452,000 | 2.6 | 116 | 161 | 57 |
| B-2 | 603,000 | 2.5 | 122 | 173 | 64 |
| B-3 | 827,000 | 2.3 | 130 | 184 | 67 |
| B-4 | 956,000 | 2.1 | 132 | 182 | 66 |
| B-5 | 751,000 | 2.6 | 127 | 180 | 60 |

COMPARATIVE SYNTHESIS EXAMPLE 1

A comparative polymer A-6 was prepared in the same manner as in Example 1 except that the monomer composition as shown in Table 5 was used. This binder resin had a weight average molecular weight of 4,300, a molecular weight peak of 4,200 and a Tg of 54° C.

TABLE 5

| Monomer Composition | Mixing proportion |
|---|---|
| Styrene | 92 parts |
| Butyl acrylate | 8 parts |
| Di-tert-butyl peroxide | 9 parts |

COMPARATIVE SYNTHESIS EXAMPLE 2

A comparative polymer B-6 was prepared in the same manner as in Synthsis Example 6 except that the monomer composition as shown in Table 6 was used. This binder resin had a weight average molecular weight of 217,000, a molecular weight peak of 198,000 and a Tg of 59° C.

TABLE 6

| Monomer Composition | Mixing proportion |
|---|---|
| Styrene | 82 parts |
| Butyl acrylate | 18 parts |
| Divinylbenzene | 0.2 part |
| Benzoyl peroxide | 0.5 part |

Preparation examples of the binder resin according to the present invention will be described below.

PREPARATION EXAMPLE 1

To 200 parts of xylene, 68 parts of polymer A-1 and 32 parts of polymer B-4 were added with stirring. Next, the mixture was heated to about 60° C. to completely dissolve the polymers A-1 and B-4 added. After the stirring was continued for about 2 hours, the xylene was removed. The resulting product is designated as binder resin 1 for the toner of the present invention.

PREPARATION EXAMPLES 2 TO 10 AND COMPARATIVE BINDER RESIN PREPARATION EXAMPLES 1 TO 3

Binder resins 2 to 10 for the toner of the present invention and comparative binder resins 1 to 3 were obtained in the same manner as in Preparation Example 1 except that the polymers as shown in Table 7 were used.

TABLE 7

Preparation of Binder Resins and Comparative Binder Resins

| Preparation example | Polymer A | | Polymer B | |
|---|---|---|---|---|
| Binder resin 2 | A-2 | 66 parts | B-5 | 34 parts |
| Binder resin 3 | A-3 | 72 parts | B-4 | 28 parts |
| Binder resin 4 | A-4 | 55 parts | B-3 | 45 parts |
| Binder resin 5 | A-5 | 68 parts | B-4 | 32 parts |
| Binder resin 6 | A-4 | 60 parts | B-4 | 40 parts |
| Binder resin 7 | A-2 | 65 parts | B-3 | 35 parts |
| Binder resin 8 | A-3 | 70 parts | B-3 | 30 part |
| Binder resin 9 | A-4 | 60 parts | B-2 | 40 parts |
| Binder resin 10 | A-5 | 65 parts | B-3 | 35 parts |
| Comp. binder resin 1 | A-2 | 100 parts | | 0 part |
| Comp. binder resin 2 | Comp. A-6 | 30 parts | Comp. B-6 | 70 parts |
| Comp. binder resin 3 | | 0 part | B-2 | 100 parts |

Note: Comp. = Comparative

Composition and physical properties of release agents used in Examples and Comparative Examples described below are shown in Table 8.

TABLE 8

| Release agent | Wax | Graft component (weight ratio) | Graft component/wax wt. ratio | Mw | Mn | Mw/Mn | Melting point |
|---|---|---|---|---|---|---|---|
| Graft-modified wax A | PE | Styrene(1)/ dibutyl fumarate(1) | 1/100 | 1,900 | 880 | 2.2 | 95 |
| Graft-modified wax B | PE | Styrene | 25/100 | 820 | 530 | 1.5 | 91 |
| Graft-modified wax C | PE | Dibutyl fumarate | 30/100 | 810 | 550 | 1.5 | 101 |
| Graft-modified wax D | PB-1 | Styrene(3)/ dibutyl maleate(1) | 5/100 | 750 | 500 | 1.5 | 81 |
| Graft-modified wax E | PE* | Styrene(1)/ dibutyl maleate(1) | 40/100 | 980 | 530 | 1.8 | 108 |
| Graft-modified wax F | PE* | Styrene(1)/ dibutyl maleate(1) | 15/100 | 1,650 | 750 | 2.2 | 115 |
| Graft-modified wax G | PW | Styrene(1)/ dibutyl maleate(1) | 18/100 | 800 | 500 | 1.6 | 82 |
| Graft-modified wax H | PE | o-Methylstyrene(1)/ dibutyl maleate(1) | 10/100 | 1,200 | 500 | 2.4 | 112 |
| Graft-modified wax I | PP | Styrene(1.5)/ dibutyl maleate(1) | 8/100 | 2,000 | 850 | 2.4 | 117 |
| Graft-modified wax J | PE | Styrene(1)/ dibutyl acrylate(2) | 10/100 | 800 | 530 | 1.5 | 93 |
| Wax 1 | PP | — | — | 4,900 | 1,300 | 3.8 | 135 |
| Wax 2 | PE | — | — | 1,150 | 560 | 2.1 | 109 |
| Wax 3 | PE | — | — | 5,200 | 1,370 | 3.8 | 128 |
| Wax 4 | PE | Styrene(1)/ dibutyl acrylate(1) | 10/100 | 1,500 | 450 | 3.3 | 78 |

PE: Polyethylene, PB: Polybutene, PW: Paraffin wax, PP: Polypropylene
*trade name: Sazol Wax H2

EXAMPLE 1

| | |
|---|---|
| Binder resin 1 | 100 parts |
| Magnetic material | 60 parts |
| Negative charge control agent | 2 parts |
| Graft-modified polyethylene wax A | 3 parts |

The above materials were premixed using a Henschel mixer, and then kneaded for 20 minutes using a twin-roll mill heated to 150° C. The kneaded product was left to cool, and then crushed with a cutter mill. Thereafter the crushed product was finely pulverized by means of a fine grinding mill making use of a jet stream, followed by classification using an air classifier to give a black fine podwer (a magnetic toner) with a volume average particle diameter of 11.2 μm.

Based on 100 parts of the magnetic toner, 0.4 part of fine colloidal silica powder was dry-blended to give a toner having colloidal silica on the surfaces of toner particles. This is designated as toner 1 of the present invention.

Grindability of toners can be represented by the throughput of the toner that can be pulverized per unit hour. In the case of the toner 1, it was 16 kg/hr at an air pressure of 5.6 kg/cm$^2$, and found very good. No melt-adhesion or the like occurred in the grinding mill.

Blocking resistance was examined on the basis of the degree of agglomeration observed when about 10 g of toner was put in a polyethylene glass of 100 cc and left to stand at 50° C. for a day. The degree of agglomeration was measured with Powder Tester manufactured by Hosokawa Micron Corporation. A product left at room temperature and the product left at 50° C. for a day showed 9 wt. % and 12 wt. %, respectively, which were substantially the same values, and the difference (ΔG) was only 3%. From these facts it was confirmed that substantially no blocking occurred.

Fixing performance, anti-offset, wind-around resistance, and image properties or durability were examined using a modified machine of a copier NP-6650, manufactured by Canon Inc.

The preset temperature of its fixing device was dropped by 5° C., at which the tests were carried out.

In particular, as to the anti-offset, the cleaning mechanism for the fixing roller was detached from the copying machine and the evaluation was made by counting, as copy durability, the number of copy sheets at which an image was stained or the fixing roller was contaiminated.

As to the fixing performance, fixed images were rubbed 10 times with lens cleaning paper "Dusper" (trademark; OZU Paper Co., Ltd.) under application of a load of about 100 g, and any peeling of the fixed images was indicated by the rate (%) of decrease in reflection density. The fixed image for evaluation was the 200th sheet when copies were continuously taken on 200 sheets.

As to the wind-around resistance, entirely solid black images were produced on three sheets, and the state of traces left on images when the sheets are peeled with peel claws of the fixing roller was examined to judge the degree to which the peeling relied on the claws.

As a result, in respect of the fixing performance, the rate of decrease was 3% and it was found very good. The anti-offset was so good that no stain or contamination was seen on images or the roller even when copies were taken on 50,000 sheets. The wind-around resistance was also found very good although traces made by the claws were slightly left on the images.

Running tests were carried out on about 10,000 sheets, using an image with an image-area percentage of about 5%. As a result, images were reproduced in a good state. Although the melt-adhesion and filming to the photosensitive member were slightly seen, the copied images were not affected at all.

The toner had a THF-insoluble matter of 4 wt. %, an Mw/Mn according to GPC of the THF-soluble matter, of 38.2, a molecular weight peak MA of 7,700, a molecular weight peak MB of 765,000, an MB/MA of 99, and a molecular weight distribution curve area ratio SA:SB:Sd of 1:0.36:0.60.

EXAMPLE 2

| | |
|---|---|
| Binder resin 2 | 100 parts |
| Magnetic material | 80 parts |
| Positive charge control agent | 2 parts |
| Graft-modified wax B | 4 parts |

The above materials were premixed using a Henschel mixer, and then kneaded for 20 minutes using a twin-roll mill heated to 150° C. The kneaded product was left to cool, and then crushed with a cutter mill. Thereafter the crushed product was finely pulverized by means of a fine grinding mill making use of a jet current, followed by classification using an air classifier to give a black fine powder (a magnetic toner) with a volume average particle diameter of 8.7 μm.

Based on 100 parts of the magnetic toner, 0.4 part of fine colloidal silica powder was dry-blended to give a toner having colloidal silica on the surfaces of toner particles. This is designated as toner 2 of the present invention.

Grindability of the toner was 5.8 kg/hr at an air pressure of 5.6 kg/cm$^2$, and found very good. No melt-adhesion or the like occurred in the grinding mill.

Blocking resistance was examined on the basis of the degree of agglomeration observed when about 10 g of toner was put inn a polyethylene glass of 100 cc and left to stand at 50° C. for a day. A product left at room temperature and the product left at 50° C. for a day showed 17 wt. % and 21 wt. %, respectively, which were substantially the same values, and the difference (ΔG) was only 4%. From these facts it was confirmed that substantially no blocking occurred.

Fixing performance, anti-offset, wind-around resistance, and image properties or durability were examined using a modified machine of a copier NP-4835, manufactured by Canon Inc.

The preset temperature of its fixing device was dropped by 10° C., at which the tests were carried out.

In particular, as to the anti-offset, the cleaning mechanism for the fixing roller was detached from the copying machine and the evaluation was made by counting, as copy durability, the number of copy sheets at which an image was stained or the fixing roller was contaminated.

The fixing performance and the wind-around resistance were also evaluated in the same manner as in Example 1.

As a result, in respect of the fixing performance, the rate of decrease was 6% and it was found very good. The anti-offset was so good that no stain or contamination was seen on images or the roller even when copies were taken on 1,000 sheets. The wind-around resistance was also found very good although traces made by the claws were slightly left on the images.

Running tests were carried out on about 30,000 sheets, using an image with an image-area percentage of about 5%. As a result, images were reproduced in a good state. No melt-adhesion nor filming to the photosensitive member was seen.

The toner 2 had a THF-insoluble matter of 2 wt. %, an Mw/Mn according to GPC of the THF-soluble matter, of 24.7, a molecular weight peak Ma of 14,000, a molecular weight peak MB of 680,000, an MB/MA of 48.6, and a molecular weight distribution curve area ratio SA:SB:Sd of 1:0.40:0.59.

EXAMPLE 3

Using the toner 2 prepared in Example 2, unfixed images were obtained by means of a modified machine of a copier FC-5, manufactured by Canon Inc.

A test for fixing the unfixed images was carried out using the external fixing device as shown in FIG. 1, comprising a pressure member that stands opposite to a heater element in pressure contact and brings a recording medium into close contact with the heater element through a film interposed between them. Used as a material of the fixing film 15 was an endless film comprising a polyimide film coated with a release layer with a thickness of 10 μm to which a fluorine resin and a conductive material were added. A silicone rubber was used as the pressure roller 18, and the fixing was carried out with a nip of 3.5 mm, under a total pressure of 8 kg between the heater element 11 and the pressure roller 18, and at a process speed of 50 mm/sec. The film was moved in the direction of the arrow in a wrinkle-free state by the action of the drive of, and tension between, the drive roller 16 and the follower roller 17.

The heater element 11 was comprised of a low heat capacitance linear heater element, to which energy was pulsewise applied and temperature control was carried out. The resistance material of the heater element 11 had a power consumption of 150 W. Temperatures were so controlled as to be the same as, or lower by 15° C. than the fixing assembly (preset fixing temperature: 180° C.) of the FC-5 modified machine, at which the tests were carried out. As a result, the fixing performance was 2% in terms of the rate of decrease without stain and contamination on both the image and the fixing film even after 3,000 sheet running, and found good. In addition, the waiting time was 3 seconds or less, and the power consumption was significantly lower than that in a heat-roller fixing system.

EXAMPLE 4

| | |
|---|---|
| Binder resin 8 | 100 parts |
| Carbon black | 4 parts |
| Positive charge control agent | 2 parts |
| Graft-modified wax A | 5 parts |

Using the above materials, a toner was prepared in the same manner as in Example 2. This toner and colloidal silica were mixed in amounts of 100 parts and 0.4 part, respectively. The resulting toner is designated as toner 3 of the present invention. In iron powder with a particle size of 200 mesh-pass and 300 mesh-on, the toner 3 was mixed in an amount of about 10 wt. % to give a developer. Only the toner was replenished.

The grindability of this toner was 15.2 kg/hr in terms of the throughput under an air pressure of 5.6 kg/cm$^2$, and was found very good. There also occurred no melt-adhesion to the interior of the grinding mill. The blocking resistance was evaluated as $\Delta G=5$, and was found not problematic at all.

Image properties and fixing performance were evaluated using a modified machine of a copier FC-3, manufactured by Canon Inc. As a result, images were reproduced in a good state, and stable images were obtained even after 1,000 sheet running. In addition, no melt-adhesion nor filming to the photosensitive drum was seen.

The preset temperature of the fixing assembly was dropped by 20° C. and also the cleaning mechanism was detached from the fixing assembly, under the state of which the above running was carried out. As a result, the fixing performance was about 5% in terms of the rate of decrease, and was found good. The anti-offset and the wind-around resistance were also found good.

The present toner had a THF-insoluble matter of 1.8 wt. %, an Mw/Mn according to GPC of the THF-soluble matter, of 29, a molecular weight peak MA of 18,000, a molecular weight peak MB of 770,000, an MB/MA of 43, and a molecular weight distribution curve area ratio SA:SB:Sd of 1:0.43:0.38.

EXAMPLES 5 to 8

Toners 4 to 7 of the present invention were obtained in the same manner as in Example 1 except that the binder resin was replaced with the binder resins as shown in FIG. 9.

EXAMPLES 9 to 11

Toners 8 to 10 of the present invention were obtained in the same manner as in Example 2 except that the binder resin and release agent were replaced with those as shown in FIG. 9.

Results of the evaluation made on the toners of Examples 5 to 11 are shown in Table 10.

COMPARATIVE EXAMPLE 1

Comparative toner 1 was obtained in the same manner as in Example 2 except that comparative binder resin 1 was used which contained 100 parts of polymer A-2 only as the binder resin.

In the case of this comparative toner, fine toner particles were formed in a large quantity when it was pulverized under an air pressure of 5.6 kg/cm$^2$, resulting in a broad particle size distribution. Thus the productivity was clearly inferior.

Using the FC-5 modified machine, the fixing performance, anti-offset, wind-around resistance, and image properties or durability were examined in the same manner as in Example 2.

As a result, in respect of the anti-offset, stain and contamination were respectively occurred on both the images and the roller when copies were taken on 20 sheets. In respect of the wind-around resistance, traces made by the peel claws were clearly left on the images. In some instances, no paper was discharged from the fixing assembly.

The present toner had a THF-insoluble matter of 0 wt. %, an Mw/Mn according to GPC of the THF-soluble matter, of 2.1, and a molecular weight peak MA of 8,900.

COMPARATIVE EXAMPLE 2 and 3

Comparative toners 2 and 3 were obtained in the same manner as in Example 2 except that the binder resins and release agents were changed to those shown in Table 9. Results of the evaluation made thereon are shown in Table 10.

TABLE 9

| | Binder resin | THF-insoluble matter | Mw/Mn | MA | MB | MB/MA | SA:SB:Sd | Release agent |
|---|---|---|---|---|---|---|---|---|
| Example: | | | | | | | | |
| 5 | 4 | 1.3 | 31 | 10,000 | 310,000 | 31 | 1:0.43:0.59 | Graft-modified wax C |
| 6 | 10 | 1.5 | 20 | 13,000 | 667,000 | 51 | 1:0.37:0.56 | Graft-modified wax D |
| 7 | 9 | 2.0 | 25 | 18,000 | 568,000 | 32 | 1:0.41:0.39 | Graft-modified wax E |
| 8 | 6 | 0.5 | 29 | 18,000 | 770,000 | 43 | 1:0.43:0.48 | Graft-modified wax F |
| 9 | 7 | 1.0 | 46 | 8,600 | 667,000 | 78 | 1:0.38:0.55 | Graft-modified wax G |
| 10 | 3 | 1.5 | 26 | 15,000 | 770,000 | 51 | 1:0.30:0.60 | Graft-modified wax H |
| 11 | 5 | 1.0 | 22 | 21,000 | 760,000 | 36 | 1:0.35:0.50 | Graft-modified wax I |
| Comparative Example: | | | | | | | | |
| 2 | Cp-2 | 12 | 16 | 4,100 | 180,000 | 44 | 1:0.83:0.47 | Wax 1 |
| 3 | Cp-3 | 1.0 | 2.4 | — | 570,000 | — | — | Wax 2 |

Cp: Comparative binder resin

TABLE 10

Results of Evaluation on Toners of the Invention and Comparative Toner

| | Grindability | Blocking resistance ($\Delta G$) | Fixing performance | Anti-offset | Melt-adhesion and filming to photosensitive member |
|---|---|---|---|---|---|
| Example: | | | | | |
| 5 | Good | 4% | 1% | Good | Same as Ex. 1 |
| 6 | Good | 4% | 4% | Good | Same as Ex. 1 |
| 7 | Good | 5% | 3% | Good | Same as Ex. 1 |
| 8 | Good | 3% | 5% | Good | Same as Ex. 1 |
| 9 | Good | 3% | 3% | Good | Not at all |
| 10 | Good | 4% | 4% | Good | Not occurred |
| 11 | Good | 4% | 2% | Good | Not occurred |

TABLE 10-continued

| Results of Evaluation on Toners of the Invention and Comparative Toner | | | | | |
|---|---|---|---|---|---|
| | Grindability | Blocking resistance (ΔG) | Fixing performance | Anti-offset | Melt-adhesion and filming to photosensitive member |
| Comparative Example: | | | | | |
| 2 | Poor | 4% | 15% | Poor | Occurred |
| 3 | Inferior | 4% | 50% | Poor | Not Occurred |

PREPARATION OF RESIN 11

In a reaction vessel, 200 parts of xylene was put, and the temperature was raised to the reflux temperature. A mixture of 90 parts of styrene monomer, 10 parts of butyl acrylate monomer and 7 parts of di-tert-butyl peroxide was mixed therein, and the solution polymerization was completed in 6 hours under reflux of xylene.

The styrene-butyl acrylate copolymer (hereinafter "St-BA copolymer") thus obtained had the physical properties as shown in the column of "Low-temperature softening resin" on "Resin 11" in Table 11.

On the other hand, 82 parts of styrene monomer, 18 parts of butyl acrylate monomer, 0.3 part of polyvinyl alcohol, 200 parts of deaerated water and 0.11 part of benzoyl peroxide were mixed and suspendedly dispersed. The resulting suspension was heated and maintained at 78° C. for 24 hours in a nitrogen atmosphere, and then the polymerization was completed to give a high-temperature softening resin as shown on "Resin 11" in Table 11.

A dried product of this high-temperature softening resin was introduced in the resin solution formed when the solution polymerization for the above low-temperature softening resin was completed, and made to completely dissolve in a solvent. Thereafter the solvent was removed. Resin 11 was thus prepared.

PREPARATION OF RESINS 12 to 15 AND COMPARATIVE RESINS 4 to 6

Resins 12 to 15 and comparative resins 4 to 6, as shown in Table 11, were respectively synthesized and prepared according to the procedure for resin 11.

EXAMPLE 12

After 100 parts of the resin 11, 70 parts of a magnetic material, 2 parts of a positive charge control agent and 4 parts of graft-modified polyethylene wax J (Mn: $5.3\times10^2$; Mw: $8.0\times10^2$; Mw/Mn: 1.5; melting point: 93° C.) in which styrene and butyl acrylates were used as graft components, the mixture was melt-kneaded using a twin-screw extruder. The kneaded product was cooled and then pulverized by means of an jet-stream grinding mill, followed by classification using an air classifier to give a black fine powder (a magnetic toner) with a volume average particle diameter of about 8.5 μm. Based on 100 parts of the resulting magnetic toner, 0.6 part of hydrophobic colloidal silica powder was added and blended to give toner A, having hydrophobic colloidal silica on the surfaces of toner particles.

Unfixed images of this toner A were obtained using a modified machine, a copier NP-1215 (manufactured by Canon Inc.) from which the fixing assembly was detached. Commercially available copy paper, Canon New Dry Paper (54 g/m$^2$; Canon Sales Inc.) was used as a recording medium.

A tests for fixing the unfixed images was carried out using a temperature-variable heat roller external fixing assembly comprising an upper roller comprised of Teflon and a lower roller comprised of silicone rubber, under conditions of a nip of 4 mm, a pressure between the upper and lower rollers, of 0.4 kg/cm in linear pressure and a process speed of 45 mm/sec, and with temperature control at intervals of 5° C. within the temperature range of from 100° C. to 230° C. The fixed images thus obtained were rubbed with lens cleaning paper "Dusper" (trademark; OZU Paper Co., Ltd.) under application of a load of 50 g/cm$^2$, and the temperature at which the rate of decrease in image density before and after the rubbing was not more than 7% was regarded as a fixing starting temperature. As to anti-offset tests, the fixed images and the rollers were observed to make evaluation.

As a result, the fixing starting temperature was as low as 120° C. and a non-offset region was seen at 110° to 215° C., showing that the low-temperature fixing had been achieved. The toner also showed a good blocking resistance. The blocking resistance was evaluated on samples obtained after toners were left in a 50° C. dry container for 3 days.

Results of the evaluation are shown in Table 13.

EXAMPLES 13 TO 16

Toners B to E were prepared using resins 12 to 15, respectively, shown in Table 11 in the same manner as in Example 12. Evaluation was made on their fixing performance.

The resulting toners are noted as Examples 13 to 16, respectively, and the results of the evaluation are shown in Table 13.

COMPARATIVE EXAMPLES 4 TO 6

Toners F to H were prepared using comparative resins 4 to 6, respectively, shown in Table 11 in the same manner as in Example 12. Evaluation was made on their fixing performance.

The resulting toners are noted as Comparative Examples 4 to 6, respectively, and the results of the evaluation are shown in Table 13.

COMPARATIVE EXAMPLE 7

Toner I was prepared in the same manner as in Example 13 except that 3 parts of wax 3 (polyethylene wax) melting at 128° C. was used as the release agent. Evaluation was made on its fixing performance. Results obtained are shown in Table 13.

COMPARATIVE EXAMPLE 8

Toner J was prepared in the same manner as in Example 12 except that 3 parts of wax 4 (graft-modified polyethylene wax) obtained by subjecting polyethylene wax (Mn: $4.5\times102$; Mw: $1.5\times103$; Mw/Mn: 3.3) to the same graft modification as in Example 1 was used as the release agent. Evaluation was made on its fixing performance. Results obtained are shown in Table 13.

As will be evident from Table 13, the toners of Examples 12 to 16 have achieved good low-temperature fixing performance, anti-offset, blocking resistance and developing performance. However, with regard to the toner of Comparative Example 4, though achievable of low-temperature fixing performance, it shows a poor anti-offset. With regard to the toner of Comparative Example 5, it shows a poor low-temperature fixing performance.

In respect of the toner of Comparative Example 6, no low-temperature fixing performance is achieved. In respect of the toner of Comparative Example 7, there are problems in the low-temperature fixing performance and developing performance.

In respect of the toner of Comparative Example 8, it has achieved the low-temperature fixing performance but shows a poor blocking resistance.

From the foregoing, it has been made clear that the toners for developing electrostatic images according to the present invention have superior low-temperature fixing performance and anti-offset, and have the composition that does not adversely affect the blocking resistance and developing performance.

EXAMPLE 17

Unfixed images were obtained using as a toner the toner A as used in Example 12.

A test for fixing the unfixed images was carried out using the external fixing device as shown in FIG. 1, provided with a pressure member that stands opposite to a heater element in pressure contact and brings a recording medium into close contact with the heater element through a film interposed between them. Used as a material of the fixing film 15 was an endless film comprising a polyimide film coated with a release layer with a thickness of 10 μm to which a fluorine resin and a conductive material were added. A silicone rubber was used as the pressure roller 18, and the fixing was carried out with a nip of 3.5 mm and at a process speed of 45 mm/sec. The film was moved in the direction of the arrow in a wrinkle-free state by the action of the drive of, and tension between, the drive roller 16 and the follower roller 17.

The heater element 11 was comprised of a low heat capacitance linear heater element, to which energy was pulsewise applied and temperature control was carried out. Temperatures were controlled in the same manner as in Example 12, i.e., at intervals of 5° C. within the range of from 100° to 230° C.

As a result, the fixing starting temperature was as low as 120° C. and a non-offset region was seen at 105° to 215° C., showing that the low-temperature fixing had been achieved. The toner also showed a good wind-around resistance.

Table 12 shows physical properties of the binder resins 11 to 15 and comparative binder resins 4 to 6.

TABLE 11

| | Low-temperature softening resin | | | | | | High-temperature softening resin | | | | | |
|---|---|---|---|---|---|---|---|---|---|---|---|---|
| | Composition/ amount (wt. %) | Mw | Mw/Mn | (1) °C. | (2) °C. | Tg °C. | Composition/ amount (wt. %) | Mw | Mw/Mn | (1) °C. | (2) °C. | Tg °C. |
| Resin: | | | | | | | | | | | | |
| 11 | St-BA (75) | $1.1 \times 10^4$ | 2.4 | 85 | 103 | 58 | St-BA (25) | $9.5 \times 10^5$ | 2.5 | 131 | 184 | 69.5 |
| 12 | St-BA (70) | $6.5 \times 10^3$ | 2.2 | 84 | 101 | 57 | St-BA (30) | $9.5 \times 10^5$ | 2.5 | 131 | 184 | 69.5 |
| 13 | St-BA (70) | $1.5 \times 10^4$ | 2.5 | 86 | 104 | 58 | St-BA (30) | $6.4 \times 10^5$ | 2.4 | 122 | 172 | 65.5 |
| 14 | St-2EHA (75) | $1.1 \times 10^4$ | 2.5 | 86 | 104 | 59 | St-2EHA (25) | $7.3 \times 10^5$ | 2.3 | 127 | 180 | 67.0 |
| 15 | St-BA (80) | $6.5 \times 10^3$ | 2.2 | 84 | 101 | 57 | St-BA-DVB (20) | $1.0 \times 10^6$ | 2.5 | 135 | 193 | 70.5 |
| Comp. binder resin: | | | | | | | | | | | | |
| 4 | St-BA (70) | $6.5 \times 10^3$ | 2.2 | 84 | 101 | 57 | St-BA (30) | $3.6 \times 10^5$ | 2.5 | 101 | 147 | 65 |
| 5 | St-BA (55) | $6.5 \times 10^3$ | 2.2 | 84 | 101 | 57 | St-BA (45) | $3.6 \times 10^5$ | 2.5 | 101 | 147 | 65 |
| 6 | St-BA (90) | $2.5 \times 10^4$ | 2.3 | 92 | 115 | 58 | St-BA (10) | $9.5 \times 10^5$ | 2.5 | 131 | 184 | 69.5 |

(1): Flow-out point,
(2): Softening point
St: Styrene,
DVB: Divinylbenzene
BA: Butyl acrylate
2EHA: 2-Ethylhexyl acrylate
Comp.: Comparative

TABLE 12

| Binder resin | THF-insoluble matter | Mw/Mn | MA | MB | MB/MA | SA:SB:Sd |
|---|---|---|---|---|---|---|
| 11 | 0.9 | 28 | $8.0 \times 10^3$ | $6.3 \times 10^5$ | 78.8 | 1:0.35:0.48 |
| 12 | 1.2 | 30 | $4.5 \times 10^3$ | $6.3 \times 10^5$ | 140 | 1:0.40:0.55 |
| 13 | 1.3 | 24 | $1.1 \times 10^4$ | $4.8 \times 10^5$ | 43.6 | 1:0.39:0.40 |
| 14 | 1.0 | 26 | $8.0 \times 10^3$ | $5.1 \times 10^5$ | 63.8 | 1:0.34:0.45 |
| 15 | 2.0 | 38 | $4.5 \times 10^3$ | $6.7 \times 10^5$ | 148.9 | 1:0.31:0.60 |
| Comp. binder resin: | | | | | | |
| 4 | 0.9 | 27 | $4.5 \times 10^3$ | $2.9 \times 10^5$ | 64.4 | 1:0.40:0.38 |
| 5 | 1.1 | 20 | $4.5 \times 10^3$ | $2.9 \times 10^5$ | 64.4 | 1:0.71:0.36 |
| 6 | 0.7 | 25 | $2.1 \times 10^4$ | $6.3 \times 10^5$ | 30 | 1:0.22:0.37 |

Comp.: Comparative

TABLE 13

| | Evaluation on Fixing Performance | | | | |
|---|---|---|---|---|---|
| | Fixing starting temp. (°C.) | Non-offset temp. range (°C.) | Fixing temp. range | Blocking resistance (50° C., 3 days) | Developing performance |
| Example: | | | | | |
| 12, Toner A | 120 | 110–215 | 95 | A | A |
| 13, Toner B | 115 | 110–215 | 100 | A | A |
| 14, Toner C | 125 | 110–210 | 85 | A | A |
| 15, Toner D | 120 | 110–215 | 95 | A | A |
| 16, Toner E | 110 | 105–210 | 100 | A | A |
| Comparative Example: | | | | | |
| 4, Toner F | 115 | 110–155 | 40 | A | A |
| 5, Toner G | 140 | 135–210 | 70 | A | A |
| 6, Toner H | 150 | 140–215 | 65 | A | A |
| 7, Toner I | 140 | 135–210 | 70 | A | BC |
| 8, Toner J | 115 | 110–215 | 100 | BC | A |
| Example: | | | | | |
| 17, Toner A | 120 | 105–215 | 95 | A | A |

A: Good, BC: Poor or problematic

As described above, the present invention can achieve a low cost in the operation of copying machines and yet can provide good images, because of the superior low-temperature fixing performance and developing performance of the toner.

We claim:

1. A toner for developing an electrostatic image, comprising a binder resin and a colorant, wherein said binder resin contains a THF-insoluble component in an amount of less than 10 wt. % based on the binder resin, and, in the molecular weight distribution measured by GPC (gel permeation chromatography) of a THF-soluble component, has a weight average molecular weight-/number average molecular weight ($\overline{M}w/\overline{M}n$) of $\geqq 18$, a molecular weight peak MA in the region of a molecular weight of from 3,000 to 20,000, a molecular weight peak MB in the region of a molecular weight of from 380,000 to 1,000,000, a molecular weight minimum Md in the region of a molecular weight of from 20,000 to 380,000, provided that MB/MA is in the range of from 30 to 150, and a molecular weight distribution curve area ratio SA:SB:Sd of 1:03 to 08:0.35 to 0.8 when the area of a molecular weight distribution curve of a molecular weight of from 400 to the Md is represented by SA, the area of a molecular weight distribution curve of a molecular weight of from the Md to 5,000,000 by SB, and the area of the region defined by a straight line connecting the apex A corresponding to the molecular weight peak MA and the apex B corresponding to the molecular weight peak MB and a molecular weight distribution curve by Sd.

2. A toner for developing an electrostatic image according to claim 1, wherein said binder resin contains the THF-insoluble component in an amount of not more than 5% by weight.

3. A toner for developing an electrostatic image according to claim 1, wherein said binder resin has an Mw/Mn of not less than 20.

4. A toner for developing an electrostatic image according to claim 1, wherein said binder resin has an Mw/Mn of from 25 to 60.

5. A toner for developing an electrostatic image according to claim 1, wherein said binder resin has a molecular weight peak MA in the region of a molecular weight of from 5,000 to 15,000, a molecular weight peak MB in the region of a molecular weight of from 450,000 to 900,000, a molecular weight minimum Md in the region of a molecular weight of from 30,000 to 300,000.

6. A toner for developing an electrostatic image according to claim 1, wherein said binder resin has an MB/MA of from 30 to 120.

7. A toner for developing an electrostatic image according to claim 1, wherein said binder resin has an MB/MA of from 40 to 100.

8. A toner for developing an electrostatic image according to claim 1, wherein said binder resin has a molecular weight peak other than the MA, in the region of a molecular weight of from 3,000 to 20,000.

9. A toner for developing an electrostatic image according to claim 1, wherein said binder resin has a molecular weight peak other than the MB, in the region of a molecular weight of from 380,000 to 1,000,000.

10. A toner for developing an electrostatic image according to claim 1, wherein said binder resin has a molecular weight minimum other than the Md, in the region of a molecular weight of from 20,000 to 380,000.

11. A toner for developing an electrostatic image according to claim 1, wherein said binder resin has a molecular weight distribution curve area ratio SA:SB:Sd of 1:0.3 to 0.7:0.4 to 0.7.

12. A toner for developing an electrostatic image according to claim 1, wherein said binder resin has a molecular weight distribution curve area ratio SA:SB:Sd of 1:0.3 to 0.6:0.5 to 0.7.

13. A toner for developing an electrostatic image according to claim 1, wherein said binder resin further comprises a release agent.

14. A toner for developing an electrostatic image according to claim 13, wherein said release agent is contained in an amount of from 0.1% by weight to 20% by weight based on the binder resin.

15. A toner for developing an electrostatic image according to claim 13, wherein said release agent is contained in an amount of from 1% by weight to 10% by weight based on the binder resin.

16. A toner for developing an electrostatic image according to claim 13, wherein said release agent has a number average molecular weight (Mn) of not more than 1,000, a weight average molecular weight (Mw) of not more than 2,500, an Mw/Mn of not more than 3, and a melting point of from 60° to 120° C.

17. A toner for developing an electrostatic image according to claim 13, wherein said release agent comprises a graft-modified wax, a low-molecular weight polyethylene wax, a low-molecular weight ethylene-propylene copolymer, a low-molecular weight polypropylene wax or a paraffin wax.

18. A toner for developing an electrostatic image according to claim 13, wherein said release agent comprises a polyolefin wax graft-modified with an aromatic vinyl monomer, an unsaturated fatty acid or an unsaturated fatty acid ester.

19. A toner for developing an electrostatic image according to claim 18, wherein said graft-modified polyolefin wax has an Mn of not more than 1,000, an Mw of not more than 2,500, an Mw/Mn of not more than 30 and a melting point of from 60° C. to 120° C.

20. A toner for developing an electrostatic image according to claim 18, wherein said graft-modified polyolefin wax has an Mn of from 400 to 700, an Mw of from 700 to 1,500, an Mw/Mn of not more than 2.0, and a melting point of from 60° to 100° C.

21. A toner for developing an electrostatic image according to claim 18, wherein said graft-modified polyolefin wax has a graft component in an amount of from 0.1 part by weight to 100 parts by weight based on 100 parts by weight of the polyolefin.

22. A toner for developing an electrostatic image according to claim 18, wherein said graft-modified polyolefin wax has a graft component in an amount of from 1 part by weight to 50 parts by weight based on 100 parts by weight of the polyolefin.

23. A toner for developing an electrostatic image according to claim 18, wherein said graft-modified polyolefin wax has a melt viscosity of from 1 cps to 250 cps at a temperature of 160° C.

24. A toner for developing an electrostatic image according to claim 1, wherein said release agent has an Mn of from 400 to 700, an Mw of from 500 to 1,500, an Mw/Mn of not more than 2.5, and a melting point of from 60° to 100° C., and is contained in an amount of from 1% by weight to 10% by weight based on the binder resin.

25. A toner for developing an electrostatic image according to claim 1, wherein;

said binder resin contains i) two kinds of styrene-acrylate copolymers, a low-temperature softening resin and a high-temperature softening resin, and ii) a graft-modified polyolefin;

said low-temperature softening resin having a weight average molecular weight (Mw) of from $5.0\times10^3$ to $3.0\times10^4$, a ratio of Mw to a number average molecular weight (Mn) (Mw/Mn) of not more than 3.0, a flow-out point in a flow tester, of from 75° C. to 90° C., a softening point of from 80° C. to 110° C., and a glass transition point (Tg) of from 55° C. to 65° C. and being contained in said binder resin in an amount of not less than 65 wt. %; said high-temperature softening resin having a weight average molecular weight (Mw) of from $4.0\times10^5$ to $1.5\times10^6$, a ratio of Mw to a number average molecular weight (Mn) (Mw/Mn) of not more than 3.0, a flow-out point in a flow tester, of from 110° C. to 160° C., a softening point of from 150° C. to 230° C., and a glass transition point (Tg) of not less than 55° C.; said low-temperature softening resin and said high-temperature softening resin being in a proportion ranging from 50:50 to 90:10 in weight proportion; and said low-temperature softening resin being obtained by solution polymerization, said high-temperature softening resin being obtained by suspension polymerization, and the both being mixed in a solvent capable of dissolving the both; and said graft-modified polyolefin having a number average molecular weight (Mn) of not more than $1.0\times10^3$, a weight average molecular weight (Mw) of not more than $2.5\times10^3$, an Mw/Mn of not more than 3.0, and a melting point of from 60° C. to 120° C.

* * * * *